US005710956A

United States Patent [19]

Kurohata et al.

[11] Patent Number: 5,710,956

[45] Date of Patent: Jan. 20, 1998

[54] IMAGE FORMING APPARATUS WITH JUDGING DEVICE FOR JUDGING WHETHER TO CONTINUE OR STOP AN INITIALIZATION PROCESS

[75] Inventors: Takao Kurohata; Kenji Taki; Yasuhiko Yamaguchi; Chiharu Kobayashi; Kojiro Akutsu, all of Hachioji, Japan

[73] Assignee: Konica Corporation, Tokyo, Japan

[21] Appl. No.: 525,911

[22] Filed: Sep. 8, 1995

[30] Foreign Application Priority Data

Sep. 16, 1994 [JP] Japan ..... 6-222287

[51] Int. Cl.[6] ..... G03G 15/00

[52] U.S. Cl. ..... 399/24; 399/77

[58] Field of Search ..... 355/200, 210, 355/211, 245, 203, 204, 208, 209; 399/13, 24, 31, 75–77

[56] References Cited

U.S. PATENT DOCUMENTS

| | | | |
|---|---|---|---|
| 4,500,195 | 2/1985 | Hosono . | |
| 4,956,668 | 9/1990 | Arnold et al. | 355/208 |
| 5,021,828 | 6/1991 | Yamaguchi et al. | 355/209 |
| 5,053,816 | 10/1991 | Takahashi | 355/208 |
| 5,107,301 | 4/1992 | Yamauchi | 399/59 |
| 5,166,730 | 11/1992 | Urabe . | |
| 5,229,815 | 7/1993 | Sulenski | 399/31 |
| 5,272,503 | 12/1993 | LeSueur et al. | 355/208 |
| 5,305,063 | 4/1994 | Marumoto . | |
| 5,444,524 | 8/1995 | Lee | 399/18 |
| 5,491,540 | 2/1996 | Hirst | 355/200 |

FOREIGN PATENT DOCUMENTS

| | | |
|---|---|---|
| 0302415 A2 | 2/1989 | European Pat. Off. . |
| 3936255 A1 | 5/1990 | Germany . |
| 06051585 | 2/1994 | Japan . |
| 06118736 | 4/1994 | Japan . |
| 06258990 | 9/1994 | Japan . |
| WO 90/00728 | 1/1990 | WIPO . |

*Primary Examiner*—Robert Beatty

*Attorney, Agent, or Firm*—Frishauf, Holtz, Goodman, Langer & Chick

[57] ABSTRACT

An image forming apparatus includes a sequence memory to store a sequence of an initialization processing to be conducted only at an installation of the apparatus, an adjuster to adjust the apparatus in accordance with the initialization, an apparatus status indicator to indicate whether the apparatus is new or not. The apparatus further includes a controller so that the adjuster adjusts the apparatus on the basis of the status of the indicator. A judging device judges whether to continue or stop the initialization process on the basis of a predetermined state of the apparatus such as whether a process unit is new or old or whether a cover is attached to a photoreceptor or not.

8 Claims, 24 Drawing Sheets

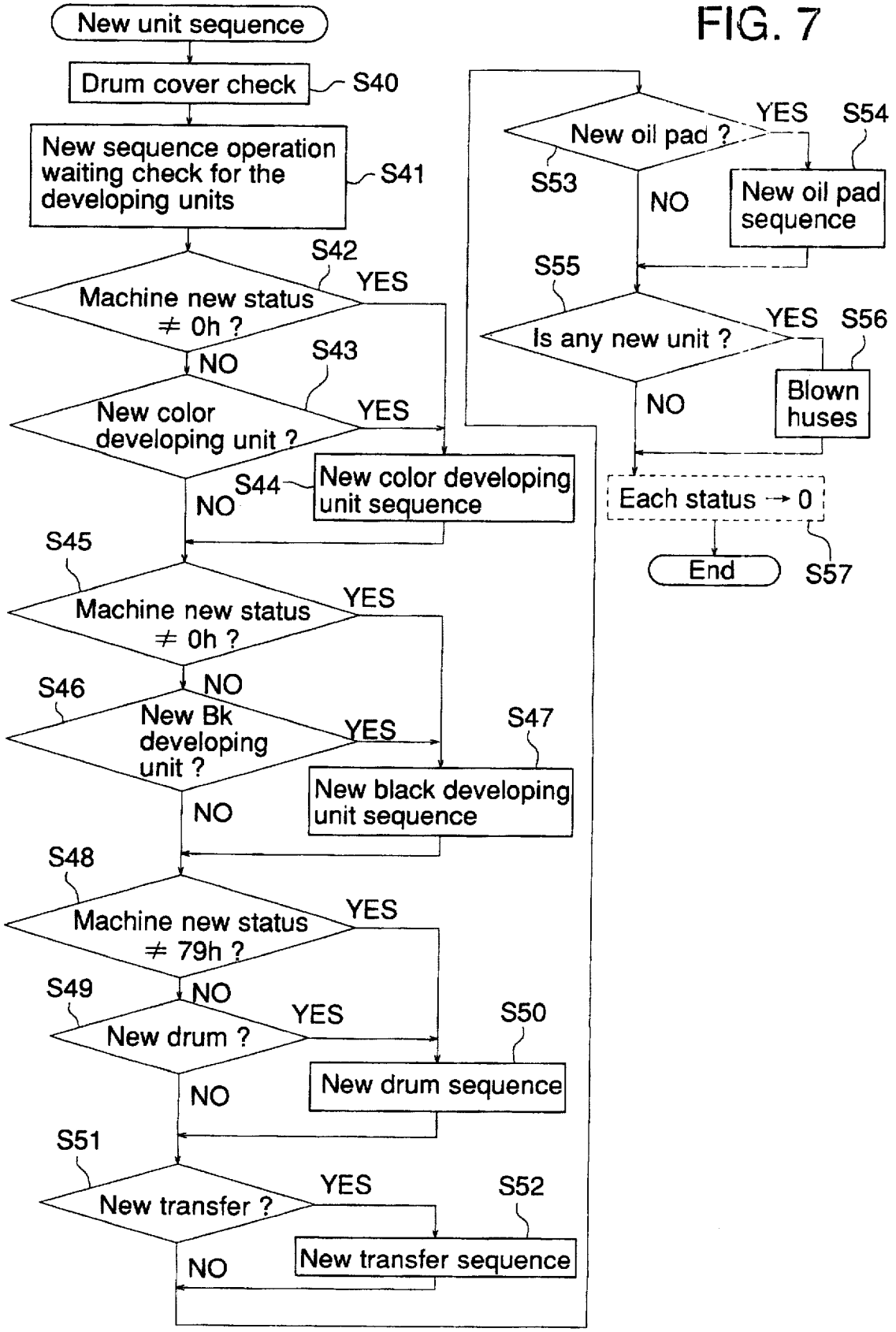
FIG. 7
New unit sequence
Drum cover check
S40
New sequence operation waiting check for the developing units
S41
S42
Machine new status ≠ 0h ?
YES
NO
S43
New color developing unit ?
YES
NO
S44
New color developing unit sequence
S45
Machine new status ≠ 0h ?
YES
NO
S46
New Bk developing unit ?
YES
NO
S47
New black developing unit sequence
S48
Machine new status ≠ 79h ?
YES
NO
S49
New drum ?
YES
NO
S50
New drum sequence
S51
New transfer ?
YES
NO
S52
New transfer sequence
S53
New oil pad ?
YES
NO
S54
New oil pad sequence
S55
Is any new unit ?
YES
NO
S56
Blown huses
Each status → 0
S57
End

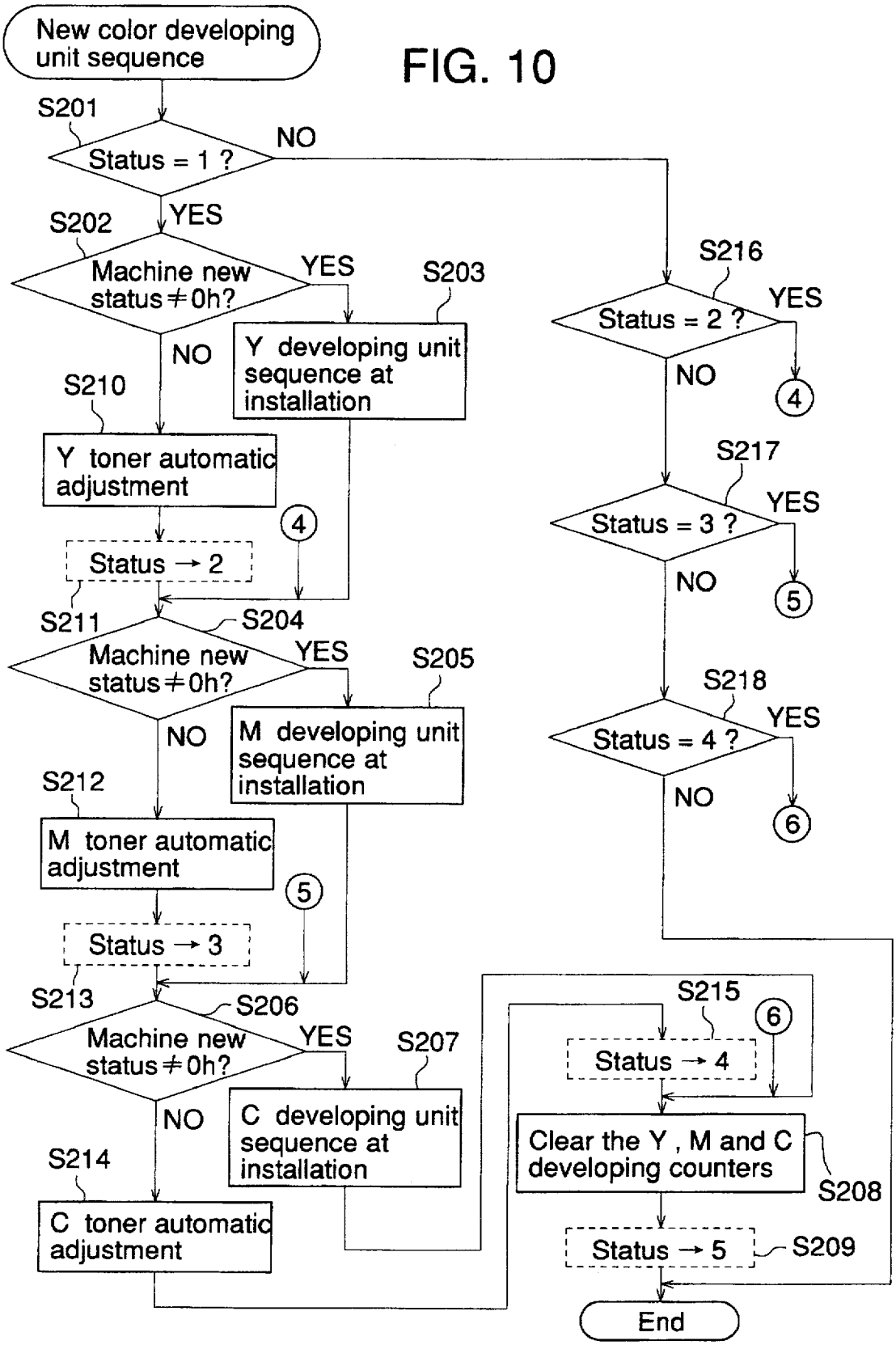
New color developing unit sequence
FIG. 10
S201
Status = 1 ?
NO
YES
S202
Machine new status ≠ 0h?
YES
S203
Y developing unit sequence at installation
NO
S210
Y toner automatic adjustment
4
Status → 2
S211
S204
Machine new status ≠ 0h?
YES
S205
M developing unit sequence at installation
NO
S212
M toner automatic adjustment
5
Status → 3
S213
S206
Machine new status ≠ 0h?
YES
S207
C developing unit sequence at installation
NO
S214
C toner automatic adjustment
S216
Status = 2 ?
YES
NO
4
S217
Status = 3 ?
YES
NO
5
S218
Status = 4 ?
YES
NO
6
S215
6
Status → 4
Clear the Y , M and C developing counters
S208
Status → 5
S209
End

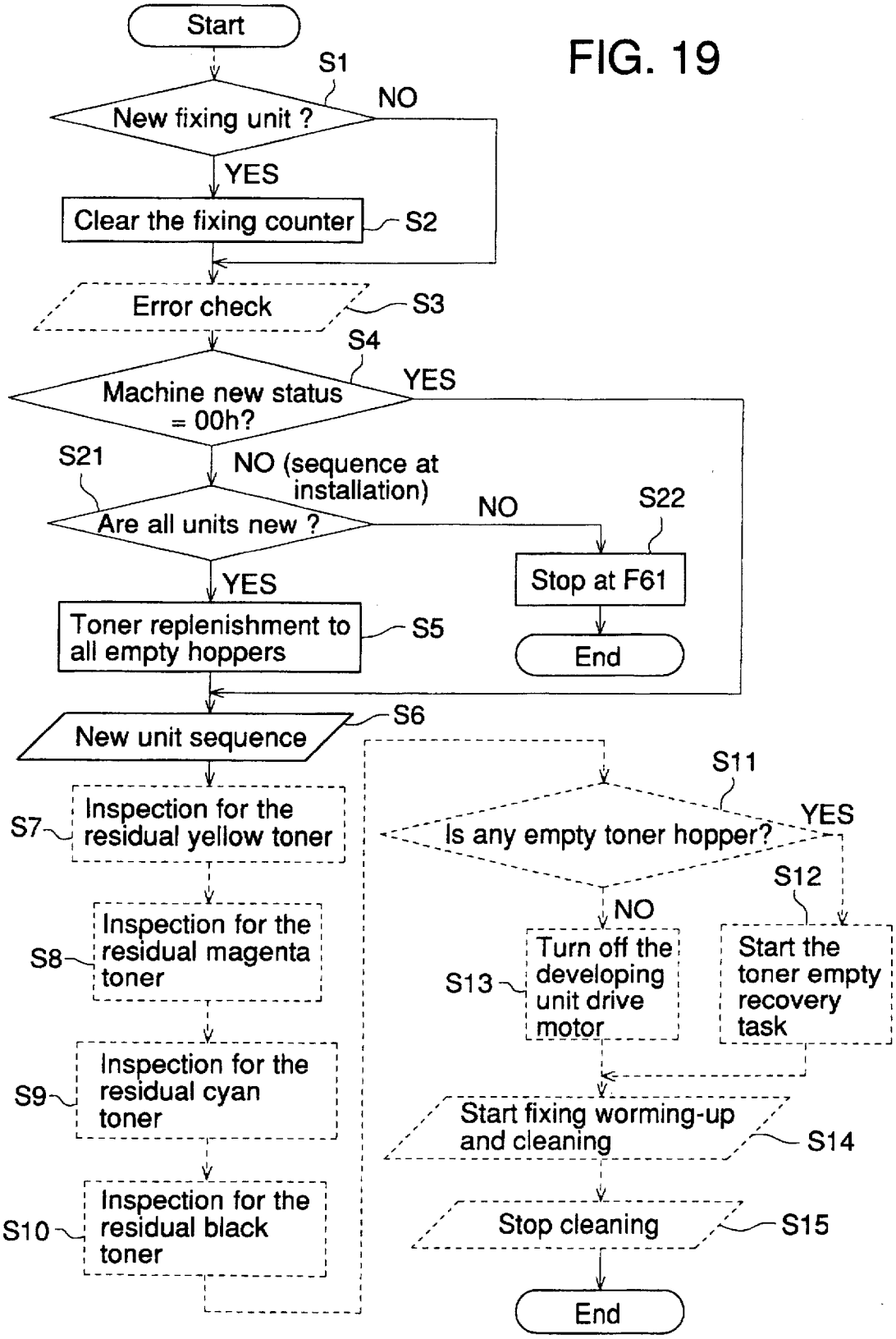
FIG. 19
Start
S1
New fixing unit ?
NO
YES
Clear the fixing counter
S2
Error check
S3
S4
Machine new status = 00h?
YES
S21
NO (sequence at installation)
Are all units new ?
NO
S22
Stop at F61
End
YES
Toner replenishment to all empty hoppers
S5
New unit sequence
S6
S7
Inspection for the residual yellow toner
S8
Inspection for the residual magenta toner
S9
Inspection for the residual cyan toner
S10
Inspection for the residual black toner
S11
Is any empty toner hopper?
YES
S12
NO
S13
Turn off the developing unit drive motor
Start the toner empty recovery task
Start fixing worming-up and cleaning
S14
Stop cleaning
S15
End

IMAGE FORMING APPARATUS WITH JUDGING DEVICE FOR JUDGING WHETHER TO CONTINUE OR STOP AN INITIALIZATION PROCESS

BACKGROUND OF THE INVENTION

The present invention relates to an image forming apparatus with automatically carries out an initializing processing operation required at installation of a new apparatus.

In an image forming apparatus such as a printer or the like, it is necessary to carry out an initial adjustment for each device at installation of a new apparatus. Conventionally, in this initial adjustment, an apparatus is designed such that a service man, who is an expert for the apparatus, carries out the adjustment, or users are instructed to refer to a user's manual and input specific data into the apparatus and themselves carry out the adjustment.

For example, the following is disclosed in U.S. Pat. No. 5,305,063. When a predetermined button provided on a machine is pressed, a toner conveyance motor, provided in a toner replenishment unit, is operated for a predetermined time, and thereby, an empty conveyance path provided between the toner replenishment unit and a toner supply opening of a developing unit is filled with toner.

Further, a technology relating to "initializing processing operations for a new developing unit" is disclosed in U.S. Pat. No. 4,956,668. Specially, when a new developing unit (in which no fuse has been blown) is installed into a machine, the developing unit is operated, and a detection signal from a toner concentration detecting section is read by a CPU, and stored in a memory as a reference value. (The reference value is automatically adjusted.)

Thus, the initializing operations necessary for a single unit are known. However, in these technologies, the following is not disclosed. Initializing operations required for a plurality of units can be correctly conducted at installation of the machine, by suggesting end-users its procedure when the sequence at installation for executing the initializing operations for a plurality of units in a predetermined procedure is installed in the machine.

However, this initial adjustment is a burden to some users, and specifically, it takes an excessively long time for a user who has no special skill in making such adjustments. Further, in these adjustments, since the apparatus has just been installed, adjustment operations are not efficiently carried out, and operation errors tend to occur.

Moreover, when an initial adjustment is incorrectly set into an apparatus, which is used for a certain period of time, there may be a possibility that the apparatus is damaged.

SUMMARY OF THE INVENTION

In view of the foregoing problems, the first object of the present invention is to automatically carry out an initial processing sequence at the installation of the apparatus.

Further, the second object of the present invention is to restart the processing sequence from a new processing sequence step even when the initial processing is interrupted.

The third object of the present invention is to judge whether a unit is new or used, for each unit, and to prevent the initial processing operation for used units.

The fourth object of the present invention is to satisfactorily initialize all units by carrying out the initializing processing operation for a unit on priority basis, which affects the adjustment for other units.

Further, a fifth object of the present invention is to effectively carry out the initializing processing required only during the manufacturing process of the apparatus.

The first embodiment of the image forming apparatus according to the present invention comprises: a sequence at installation memory means in which an initializing processing sequence, carried out only at the installation of a new apparatus, is stored; and a sequence executing means at installation, to carry out initializing processing according to the sequence at the installation, when a new apparatus is installed.

The second embodiment of the image forming apparatus of the present invention comprises: a plurality of units which are respectively required to be initially adjusted at their new articles; an apparatus status memory means to change and store the status of the apparatus at its installation corresponding to progression of the initializing processing sequence; a unit status memory means to change and store the status of the units corresponding to progression of their initial adjustment, wherein the sequence executing means at installation carries out initializing processing at the installation of the apparatus using information stored in the apparatus status memory means and the unit status memory means.

The third embodiment of the image forming apparatus of the present invention comprises a sequence of the initializing processing structured such that: the sequence skips the completed processing operations after the interruption of the initializing processing operation, and restarts from the subsequent processing operation, according to information stored in the apparatus status memory means and the unit status memory means.

The fourth embodiment of the image forming apparatus of the present invention comprises a judging means to judge whether a plurality of units are new or used, wherein the initializing processing sequence is structured to advance the initializing processing operation based on information including a result from the judging means.

In the fifth embodiment of the image forming apparatus of the present invention, the initializing processing sequence carries out toner concentration adjustment for developing units prior to other units, in the initial adjustment for each unit at installation of new units.

In the sixth embodiment of the image forming apparatus of the present invention, the apparatus is structured such that a process mode judgement signal is inputted during the manufacturing process, and the initializing sequence is structured to include a function for judging the process mode by an inputted signal, and a function for skipping a part of the initializing processing at installation of the apparatus and for carrying out processing required only during the process mode, when the process mode is judged.

According to the image forming apparatus of the first embodiment of the present invention, the initializing processing required at installation is automatically carried out according to the stored initializing processing sequence when a new apparatus is installed.

According to the image forming apparatus of the second embodiment of the present invention, the initializing processing can be stably carried out while seizing information of the status corresponding to the progression of the processing operation for the apparatus and information of the status of the progression of the initializing processing operation for units during the progression of the initializing processing operation at the installation of a new apparatus.

According to the image forming apparatus of the third embodiment of the present invention, wasteful overlap of the processing operation is avoided since the initializing sequence can be restarted from the subsequent processing operation by skipping completed processing operations after interruption of the initializing processing operation, corresponding to the status at installation of the apparatus and the status of progression of adjustment for each unit.

According to the image forming apparatus of the fourth embodiment of the present invention, faulty operation, due to faulty detection, can be securely prevented since the status of units can be checked twice whether these units are new or used, according to status information of the apparatus and judgement information of new or used units.

According to the image forming apparatus of the fifth embodiment of the present invention, adjustment of the toner concentration for the developing units is carried out prior to adjustment for other units in the initializing processing, and thereby, change of the toner concentration, during adjustment of other units, can be prevented.

According to the image forming apparatus of the sixth embodiment of the present invention, the process mode is judged and the initializing processing operation, required only during the manufacturing process, is carried out, so that the operation efficiency is increased during the manufacturing process.

BRIEF DESCRIPTION OF THE DRAWINGS

FIG. 7 is a flow chart showing an initializing processing subroutine in the same example.

FIG. 10 is a flow chart showing a subroutine in the same example.

FIG. 19 is a flow chart showing a main initializing processing routine conducted at the power supply in the second example of the present invention.

DETAILED DESCRIPTION OF THE PREFERRED EMBODIMENT

Figure 1:
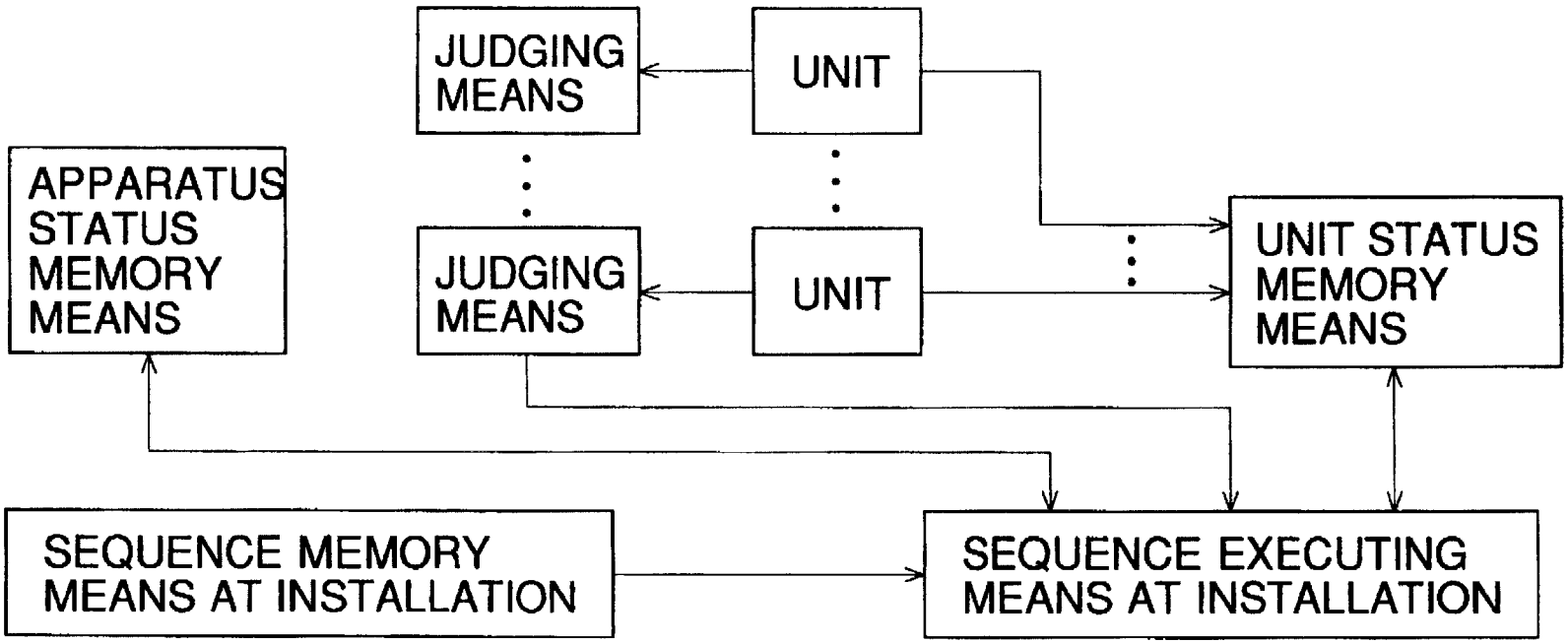
FIG. 1 is a block diagram showing the structure and the function of the present invention.

Referring to the drawings, examples of the present invention will be described below.

Figure 2:
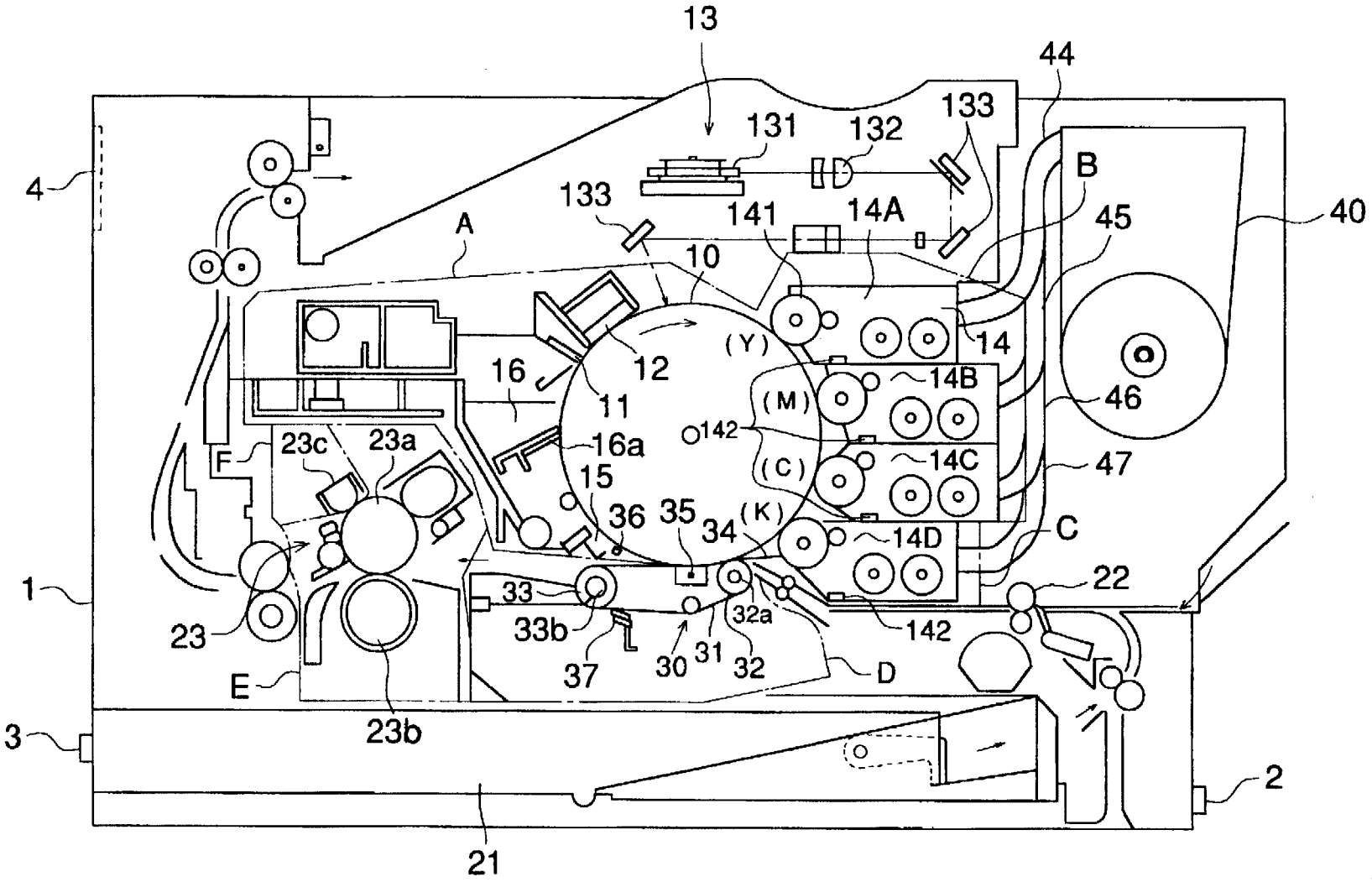
FIG. 2 is a vertical sectional view showing the entire structure of a color laser printer according to an embodiment of the present invention.

FIG. 2 shows a structure of a laser color printer as an example of an image forming apparatus according to the present invention.

An outline of its structure and operations will be explained. A photoreceptor drum 10, on the surface of which an OPC photoreceptor layer is coated, is driven in one direction (clockwise in the drawing), and after the electrical charge during the previous printing has been removed by a discharger 11, the peripheral surface of the photoreceptor drum is uniformly charged by a charger 12, and the photoreceptor drum is ready for a new print.

After this uniform charging, image exposure is carried out by an image exposure means 13 according to an image signal. In the image exposure means 13, rotational scanning is conducted by a laser beam emitted from a laser light source, not shown in the drawing, using a polygonal mirror 131, and the optical path of the beam is bent by a reflection mirror 133 through an fθ lens 132 or the like. After that, the laser beam is projected onto the peripheral surface of the previously charged photoreceptor drum 10, and a latent image is formed on the surface of the drum.

Developing units 14 in which developer, composed of the mixture of toner (coating material) such as yellow (Y), magenta (M), cyan (C), black (Bk), or the like, and carrier (magnetic material), is respectively loaded, are provided around the photoreceptor drum 10. Initially, the first color development is carried out by a developing sleeve 141 in which a magnet is housed and which rotates holding thereon the developer. The thickness of the developer is regulated to a predetermined value on the developing sleeve 141, and the developer is conveyed to a developing area. An AC bias voltage $V_{AC}$ and a DC bias voltage $V_{DC}$ are superimposed between the photoreceptor drum 10 and the developing sleeve 141. When the potential voltage (ground potential voltage) of the exposed portion of the photoreceptor drum 10 is $V_L$, that of the surface of the charged photoreceptor layer except the exposed portion is $V_H$, and the potential voltage of the DC bias voltage $V_{DC}$ is set to satisfy the relationship $V_H$>VDC>$V_L$, then, toner, which is triggered to separate from carrier by the AC bias voltage $V_{AC}$, does not adhere to a portion of the potential voltage $V_H$ which is higher than $V_{DC}$, but adheres to an exposed portion of the potential voltage $V_L$ which is lower than $V_{DC}$. Thereby, a latent image is visualized and developed. In this connection, toner concentration sensors 142, to detect the toner concentration of each color developer, are provided in developing units.

After the first color development is completed by the above operation, the sequence enters into the second color (for example, magenta) image forming process. The photoreceptor drum 10 is uniformly charged again, and a latent image according to the second color image data is formed by the image exposure means 13. The third color (cyan) and the fourth color (black) image formation processes are carried out in the same way as the second color image formation process, and four color development processes in total are carried out in sequence on the peripheral surface of the photoreceptor drum 10.

On the other hand, a recording sheet P fed from a sheet feed cassette 21 by a sheet feed mechanism 22, is conveyed to a nip portion (transfer area) 35 formed between the photoreceptor drum 10 and a transfer belt 31 by a transfer belt device 30 on which a transfer belt 31 is stretched, and a multi-color image on the surface of the photoreceptor drum 10 is collectively transferred onto the recording sheet P. Here, a high voltage is impressed on a shaft 32*a* on the upstream side holding roller 32 of the transfer belt 31. A conductive brush 34, located at a portion opposed to the shaft 32*a*, is grounded, the transfer belt 31 being sandwiched between the shaft 32*a* and the brush 34. The recording sheet enters between the brush 34 and the transfer belt 31, and then enters the transfer area while being attracted by the transfer belt 31 due to electric charges injected from the brush 34 onto the recording sheet P. The recording sheet P, separated from the photoreceptor drum 10, is separated from the transfer belt 31 while being electrically discharged by using a shaft 33*b* of the downstream side holding roller 33, with which the transfer belt 31 is tensioned, as a counter electrode. Toner adhered to the transfer belt 31 is removed by a cleaning blade 37. In this connection, the transfer belt 31 is separated from the photoreceptor drum 10 during the multicolor image formation while using the shaft 33*b* of the downstream side holding roller 33 as a rotation center.

The recording sheet P separated from the transfer belt device 30, is conveyed to the fixing device 23 composed of two pressure rollers 23*a* and 23*b* in which a heater is provided at least inside the upper roller. The adhered toner is fused when heat and pressure are applied between the two pressure rollers, and after it has been fixed onto the recording sheet P, the recording sheet P is conveyed outside the apparatus. An oil pad 23*c*, to wipe off the toner adhered by the heat, is equipped to the upper pressure roller 23*a*.

The toner remaining on the peripheral surface of the photoreceptor drum 10 after transfer is discharged by the discharger 15. After that, the toner reaches a cleaning unit 16, and is scraped down into the cleaning unit 16 by the cleaning blade 16*a* which is in contact with the photoreceptor drum 10. After the toner has been conveyed outside the cleaning unit by a screw or the like, the toner is stored in a collection box. The photoreceptor drum 10 from which the residual toner is removed by the cleaning unit 16, is exposed by the discharger 11, and after that, uniformly charged by the charger 12. Then, the photoreceptor drum 10 enters into the next image formation cycle. When the recording sheet is not separated from the transfer belt 31, but wound around the photoreceptor drum 10, and enters the area above the discharger 15, there is a possibility that the cleaning blade 16*a* or an electrode wire is damaged. Therefore, a JAM sensor 36 to detect an adhered recording sheet is mounted near the discharger 15.

Figure 3:
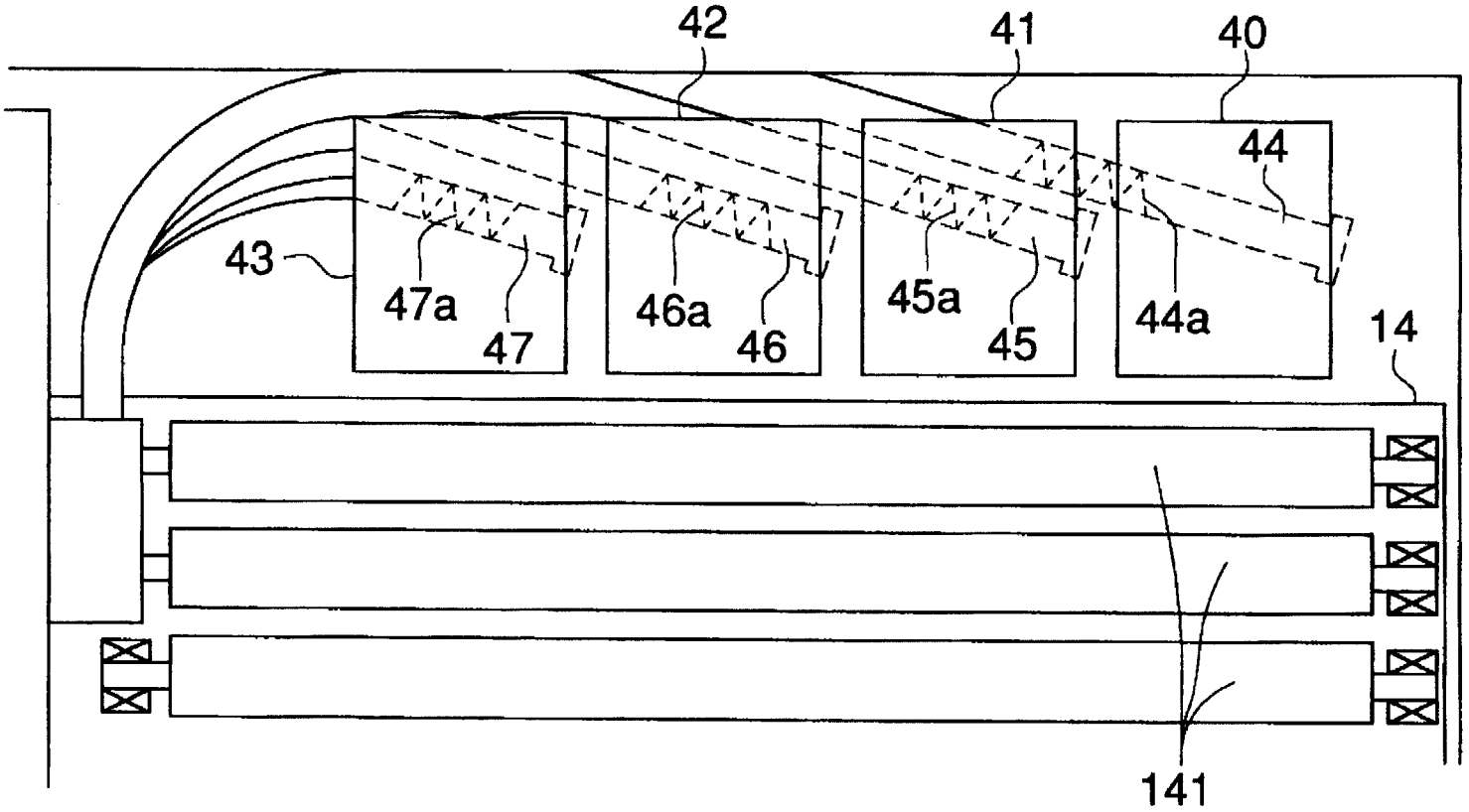
FIG. 3 is a horizontal sectional view showing a portion of the printer.

As shown in FIG. 3, hoppers 40 to 43 in which yellow, magenta, cyan and black toners are respectively loaded to supply these toners to respective developing units, are provided in the apparatus. Further, conveyance pipes 44 to 47 to convey these toners to each developing unit by rotation of the screws 44*a* to 47*a* which are provided in the pipes and driven by a developing unit drive motor, not shown in the drawing, are provided in the apparatus.

Further, a power switch 3 and a display section 4 to display various types of messages are provided on the apparatus main body 1.

In this type of laser printer, a plurality of replaceable units are provided in the apparatus main body 1 for each component having each different function.

Figure 4:
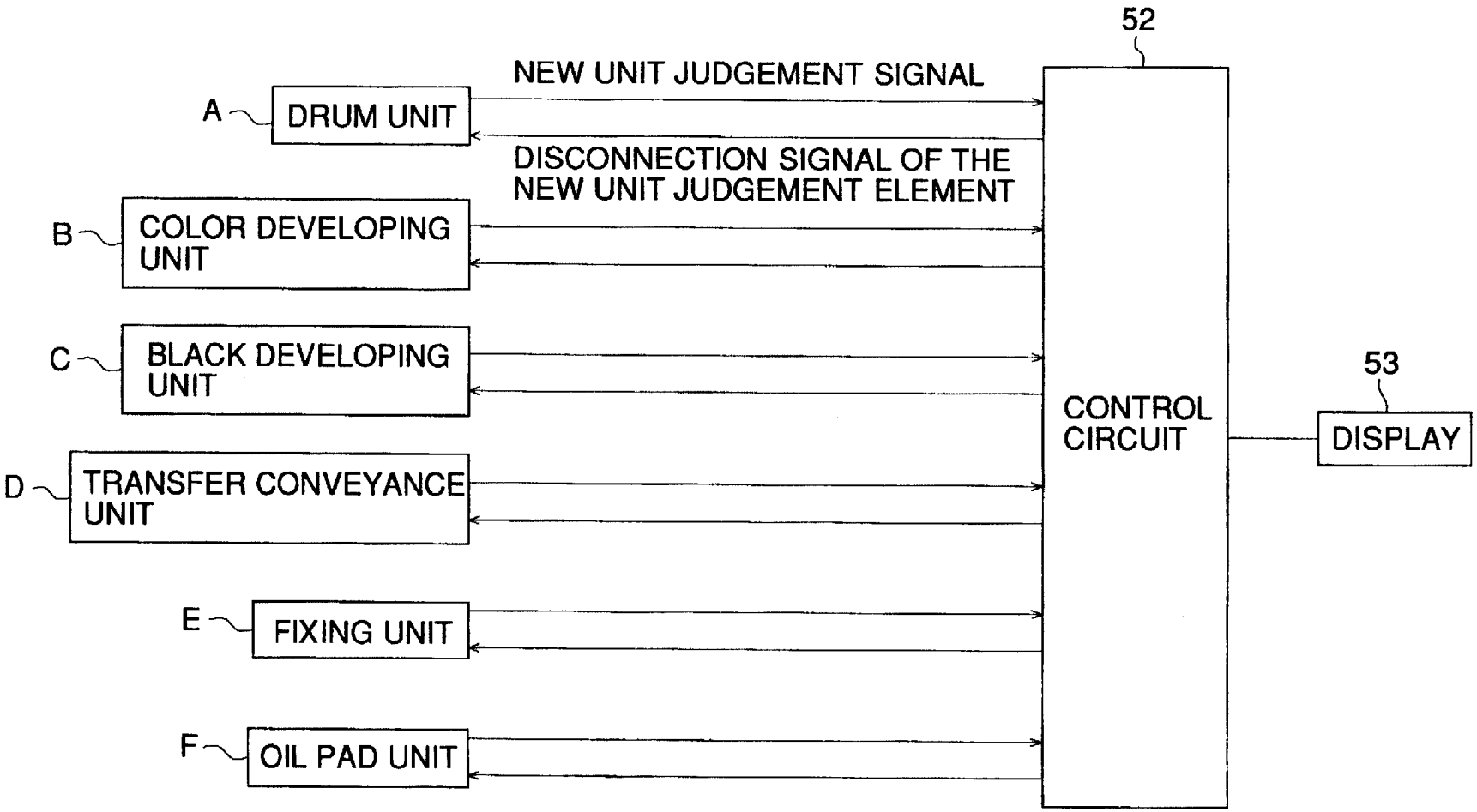
FIG. 4 is a circuit block diagram of a main portion of the same example.

Referring to FIG. 4, each unit will be explained below. The following units are provided in the apparatus main body 1: a drum unit A composed of the photoreceptor drum 10, the discharger 15, and the like; a color developing unit B integrally provided with yellow, magenta and cyan developing units; a black developing unit C composed of one black developing unit; a transfer and conveyance unit D composed of the transfer unit 30 provided with the transfer belt 31, the holding rollers 32 and 33; a fixing unit E composed of the fixing unit provided with the pressure roller, and the like; and a oil pad unit F composed of the oil pad 16*a*, and the like. These units are controlled by a control circuit 52 while the units send and receive signal data, including data expressing that the unit is new or used, to and from the control circuit 52, corresponding to connection or disconnection of fuses, which will be described later, and messages, including a unit fault message, are displayed on a display unit 53.

Figure 5:
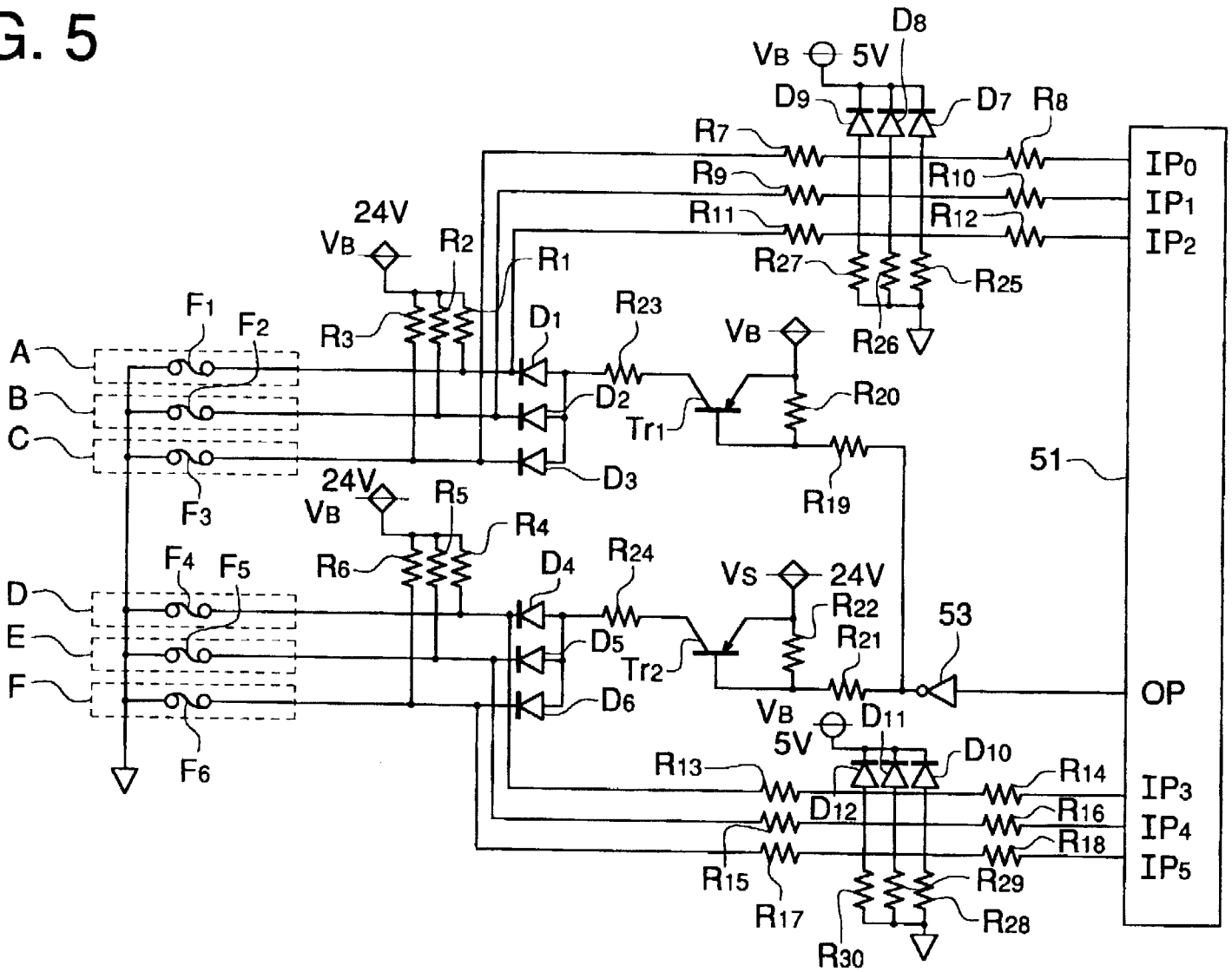
FIG. 5 is a view showing details of the main portion of the same circuit.

Then, a means for detecting a new unit or a new apparatus when units A through F are respectively replaced with new units, or when the entire apparatus is replaced with a new one, is provided in the apparatus, and structured as follows. That is, as shown in FIG. 5, when units A through F are respectively installed in the apparatus main body 1, fuses F1 to F6 are respectively provided on each unit, A to F, one end of each of which is connected to the power supply VB(+24V) in the apparatus main body 1 through a contact point such as a pressure-type spring or the like, not shown in the drawing, through one of resistors $R_1$ through $R_6$, and the other end of each of which is grounded.

Potential voltage at the connection point of each of fuses $F_1$ to $F_6$ is inputted into individual input terminals IP0 to IP5 of an interface 51 respectively through resistors $R_7$, $R_8$, resistors $R_9$, $R_{10}$, resistors $R_{11}$, $R_{12}$, resistors $R_{13}$, $R_{14}$, resistors $R_{15}$, $R_{16}$, and resistors $R_{17}$, $R_{18}$, and is read into the control circuit 52 through the interface 51. An inverter 53 is connected to an output terminal OP of the interface 51. An output terminal of the inverter 53 is connected to the power supply $V_B$ through resistors $R_{19}$, $R_{20}$, and connected to a power supply $V_S$ through resistors $R_{21}$, $R_{22}$. Emitters of transistors $T_{r1}$ and $T_{r2}$ are connected to the power supply $V_B$. Bases of transistors $T_{r1}$ and $T_{r2}$ are respectively connected to the connection point of the resistors $R_{19}$ and $R_{20}$ and the connection point of the resistors $R_{21}$ and $R_{22}$. Collectors of transistors $T_{r1}$ and $T_{r2}$ are respectively connected to each of fuses $F_1$ to $F_6$ through the resistor $R_{23}$, parallely connected diodes $D_1$ to $D_3$, the resistors $R_{24}$, and parallely connected diodes $D_4$ to $D_6$.

Each connection point of resistors $R_7$ and $R_8$, resistors $R_9$ and $R_{10}$, and resistors $R_{11}$ and $R_{12}$, is respectively connected to a low voltage power source (for example, 5V) through diodes $D_7$, $D_8$ and $D_9$, and is respectively connected to resistors $R_{25}$, $R_{26}$ and $R_{27}$. Each connection point of resistors $R_{13}$ and $R_{14}$, resistors $R_{15}$ and $R_{16}$, and resistors $R_{17}$ and $R_{18}$, is respectively connected to a low voltage power source (for example, 5V) through diodes $D_{10}$, $D_{11}$ and $D_{12}$, and is respectively connected to resistors $R_{28}$, $R_{29}$ and $R_{30}$.

When each unit is new, each of fuses $F_1$ through $F_5$ respectively corresponding to each unit is connected, and the unit is judged to be new by a control circuit 52 into which the ground voltage of the connection point of the fuse is inputted. After the unit has been used after installation of the apparatus, a fuse corresponding to the Unit is blown when a sequence at installation, which will be described later, and which is conducted on each unit at installation of the apparatus, has been completed, and accordingly the input potential voltage is increased, thereby it is judged that the unit is a used one.

When the apparatus is new, an initial value showing that the apparatus is new, for example 70 h (hexadecimal) is stored as a value of the status showing the condition of the apparatus (machine new status) in a predetermined address (for example, 01) of a memory provided in the control circuit 52. For this memory, a non-volatile memory, in which stored data is not eliminated at the stoppage of power supply, is used. An apparatus status memory means is composed of this type of memory.

Figure 6:
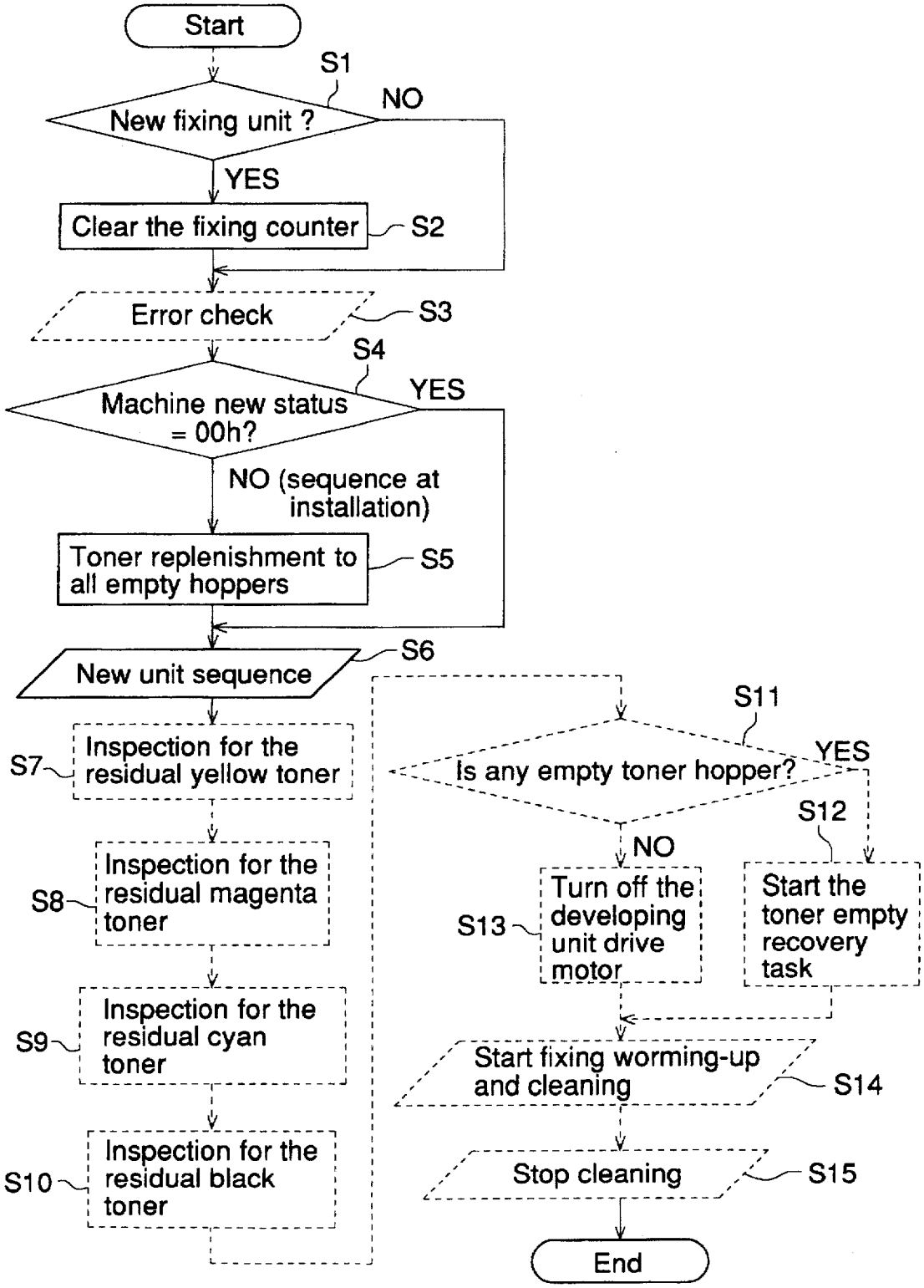
FIG. 6 is a flow chart showing the main routine of initializing processing operations conducted at the power supply in the same example.

Next, operations at the time of power supply in this circuit is conducted as shown in FIG. 6 and following drawings. This routine is conducted when a power supply switch 3 for the apparatus main body 1 is turned on in the normal printing mode.

In step (expressed by S in the drawing, hereinafter) 1, it is judged, according to the input potential voltage which is different depending on the connection or disconnection of the fuse $F_5$ corresponding to the fixing unit E as described above, whether the fixing unit E is new or used. When a new apparatus is installed, the fixing unit is judged to be new and the sequence advances to step 2, and a value in a fixing counter is cleared which counts the number of printing cycles after the fixing unit E is started for use. Further, when data for return prevention remains in the counter in the case of fixing fault, this data is cleared.

Next, the sequence advances to step 3 and an error check is carried out. This check is carried out by two kinds of methods, that is, by a key-word or by a signal. In the error check by a key-word, when some fault occurs, the faulty status data is stored in an SRAM (data is cleared at the time of OFF/ON of the power supply) or a non-volatile RAM (data is not cleared at the time of ON/OFF of the power supply). When such error data is found, the machine is stopped and an error message is displayed according to this stored data. In the error check by a signal, the signal is checked to detect the faulty status, and when an error is detected, the machine is stopped and the appropriate error message is displayed.

Error check is carried out just after initializing of the fixing unit E for the following reason: when data for return prevention, due to occurrence of fixing fault, remains without being cleared at replacement of the fixing unit E, although the fixing unit E has been replaced, the sequence can not return to the original routine due to this data at the time of the error check, and accordingly, this data is cleared as the first step when the fixing unit E is replaced.

Next, the sequence advances to step 4, and it is judged by the value of Machine new status (which is 00h before installation) whether the machine is at installation or not. The sequence advances to step 5 at installation, and toner is replenished to all hoppers which are empty at installation. When this replenishment has been completed, the value of the Machine new status is changed from 70h, which is the initial value at installation, to 71h.

After this toner replenishment, the sequence advances to step 6, and initialization at installation (New-unit sequence), which is conducted for new units, is carried out.

FIG. 7 shows a subroutine of the New-unit sequence.

Figure 8:
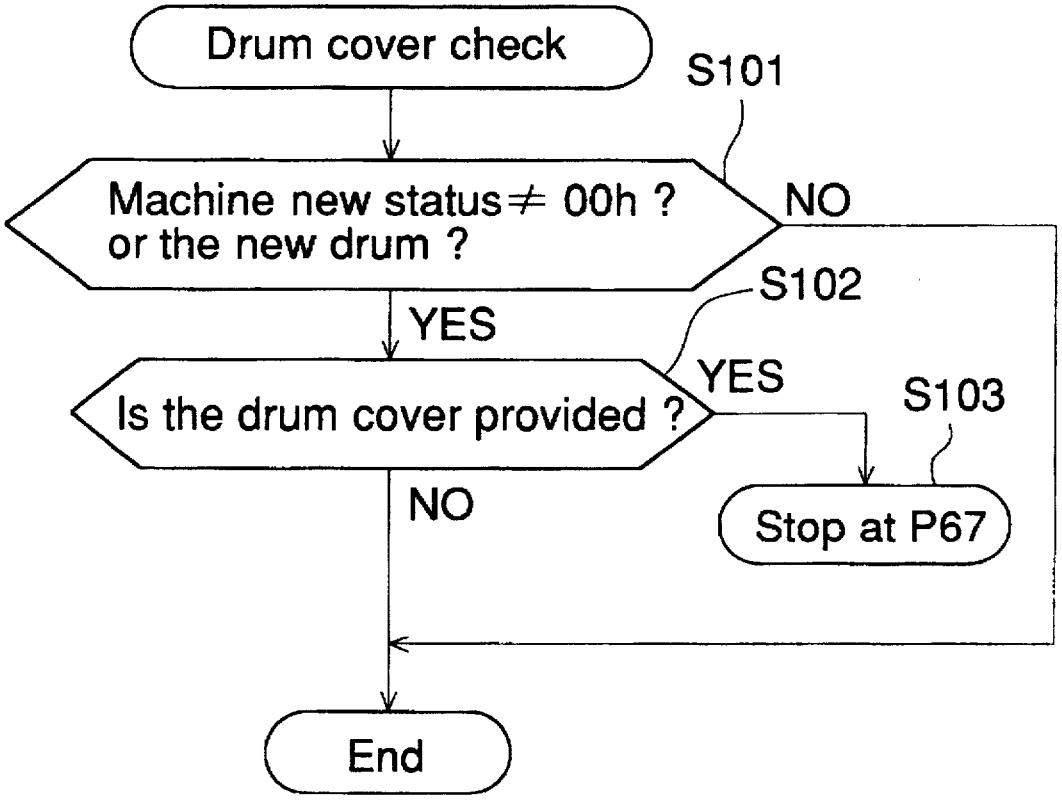
FIG. 8 is a flow chart showing a subroutine in the same example.

In FIG. 7, a drum cover check is carried out in step 40. The drum cover check is carried out as follows. Referring to FIG. 8, when the status value of the apparatus shows a status of a new apparatus (that is, the installation of the new apparatus) in step 101, or when it is judged that a drum unit A is new (that is, at the replacement), the sequence advances to step 102. Then, it is judged whether a drum cover, which protects the drum surface from damage during its transportation, is provided on the drum or not. This drum cover is detached from the drum unit A at its installation or its replacement. When it is not detached from the drum unit A, the sequence advances to step 103, and "no-detachment" is displayed and the initializing operation is stopped. When the drum cover is then detached, the drum cover check is completed and the sequence advances to step 41 in FIG. 7. When the judgement in step 101 is NO, the drum unit is a used one. Therefore, the drum cover check is not conducted and the sequence advances to step 41 in FIG. 7.

Figure 9:
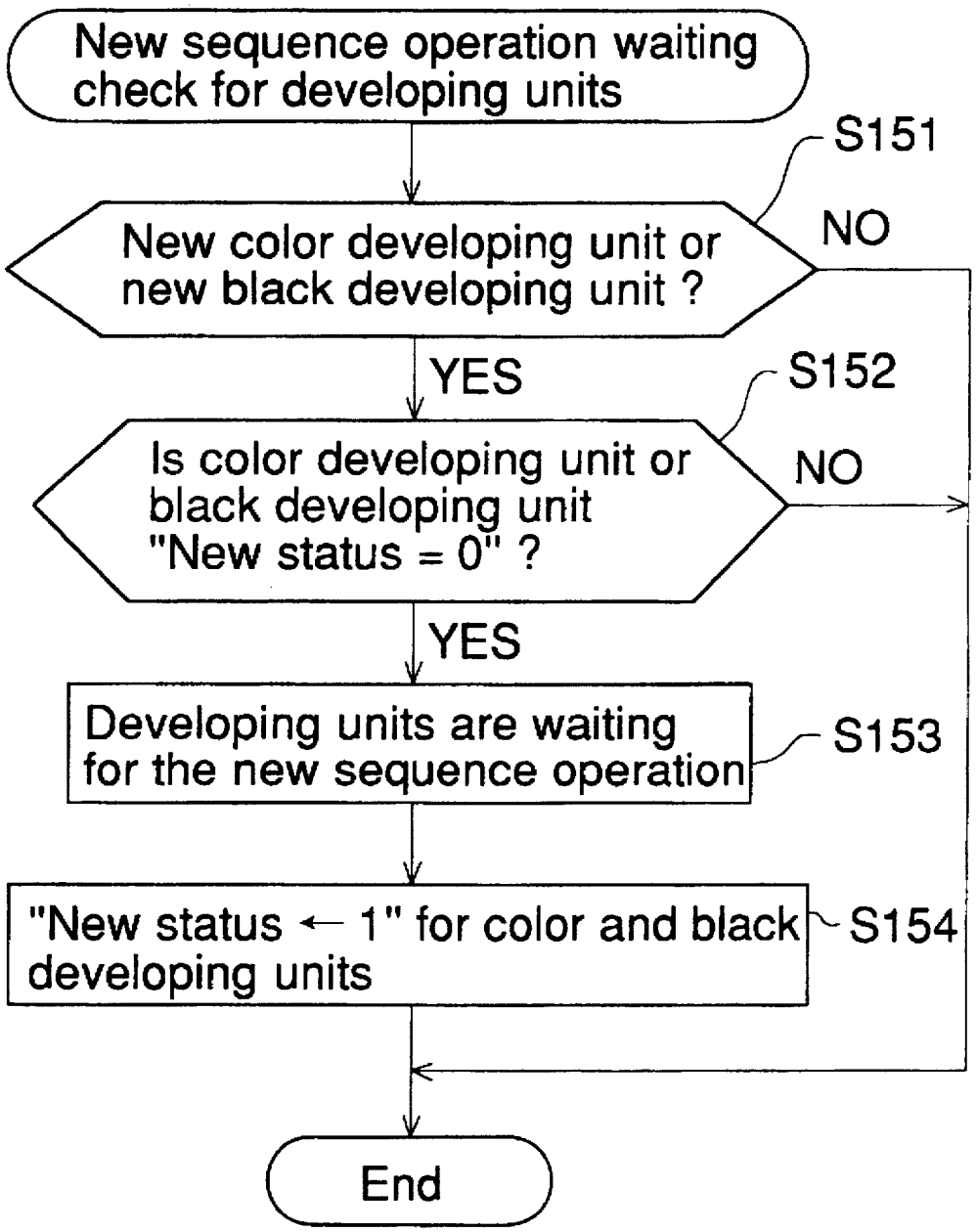
FIG. 9 is a flow chart showing a subroutine in the same example.

In step 41, a New sequence operation waiting check for developing units is carried out. In FIG. 9 which shows this subroutine, it is judged in step 151 whether the color developing unit B or the black developing unit C is new or not. At installation, both developing units B and C are new. In this case, it is judged in step 152 whether the status value for judging the status of developing units B and C is 0 or not. The status value is an initial value 0 in the initial stage at installation. In this case, the sequence advances to step 153, and the status in which a developing unit new sequence starts, which is conducted on a new developing unit, is set by a key operation, or the like, in this step. After that, the sequence advances to step 154, and the status value of the color developing unit B and the black developing unit C is increased to 1.

Further, also when at least one of both units is replaced with a new one, the sequence advances from step 151 to step 154, in the same way as above.

On the other hand, when the judgement in step 151 is NO and both developing units are used ones, the sequence is completed without conducting the new sequence operation waiting check for developing units. In this case, the status of both developing units B and C remains at 0.

In the case where the judgement in step 152 is NO, when the status value of both units is 1, the sequence skips steps 153 and 154 because the sequence is interrupted while waiting the new sequence operation for developing units, or during operation of a new sequence for developing units, which will be described later.

After the new sequence operation waiting check for developing units, it is judged by the value of Machine new status in step 42 in FIG. 7, whether the developing units are at installation or not. When it is judged to be at installation, the sequence advances to step 44, and the initializing operation for a new color developing unit B (a New color developing unit sequence) is carried out. When it is judged to not be at installation in step 42, the sequence advances to step 43, and it is judged whether the color developing unit B is new or not. When it is judged to be new, the sequence advances to step 44, and the New color developing unit sequence is carried out in the same way as that at installation.

In FIG. 10, showing a subroutine of the new color developing unit sequence, in step 201, it is judged whether the status showing the condition of the color developing unit B is 1 or not, which is set in step 154 in FIG. 9. When the status of the new color developing unit is judged to be new, the sequence advances to step 202. When the status is judged to be at installation by the value of the Machine new status, the sequence advances to step 203, and the initializing operation for the yellow developing unit (Y developing unit sequence at installation) is carried out.

Figure 11:
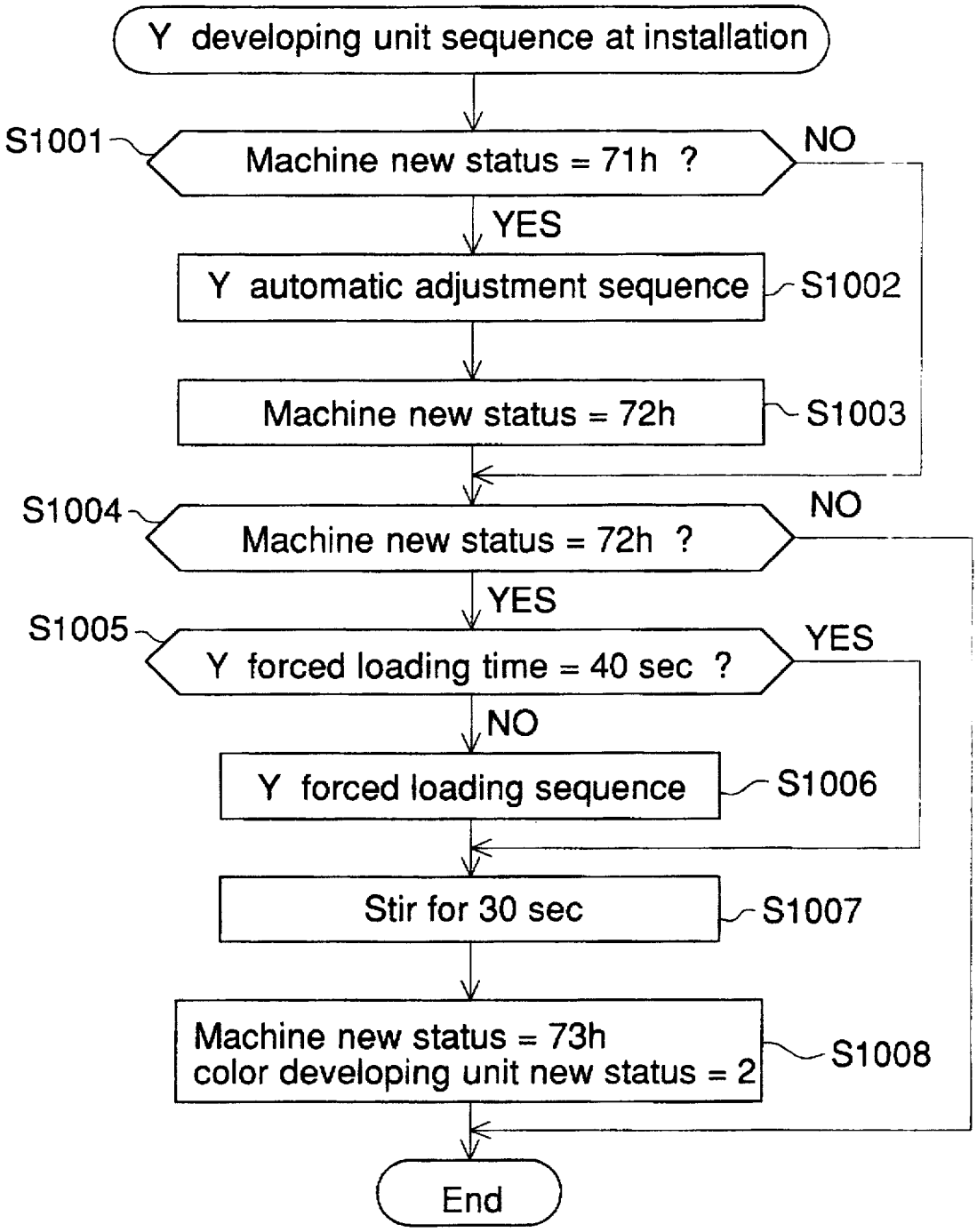
FIG. 11 is a flow chart showing a subroutine in the same example.

In FIG. 11, showing the Y developing unit sequence at installation, it is judged in step 1001 whether the value of the Machine new status is a value of 71h after the toner replenishment into the hopper. At its installation, since the judgement is YES, the sequence advances to step 1002, and an automatic adjustment sequence for Y toner is carried out. The automatic adjustment sequence is a sequence to adjust the toner concentration in the Y developing unit. Toner and carrier, of which developer in the new developing unit is composed, are respectively loaded in the unit at an almost constant ratio, and accordingly, the toner concentration is constant after these are fully stirred. Accordingly, the output value from a concentration sensor, provided in the developing unit, in regard to the toner concentration at the time of completion of stirring is stored. The detected value of the toner concentration compared to the output value of the concentration sensor is adjusted by using the output value as a reference. Thereby, fluctuation of the output of the concentration sensor can be eliminated, and the accuracy of concentration adjustment for succeeding printing can be enhanced. After this automatic adjustment sequence for Y toner has been completed, the value of the Machine new status is changed to 72h in step 1003.

After the judgement whether the Machine new status is 72h or not, in step 1004, Y toner is replenished for a predetermined time (40 sec) from the hopper, and is loaded into an empty pipe 44 provided from the hopper to the Y developing unit 14Y (steps 1005, 1006). After developer is stirred for a predetermined time (30 sec) in the Y developing unit so that a small amount of toner, spills from the pipe 44 into the developing unit 14Y, is mixed (step 1007), the value of the Machine new status is set to 73h, and a status value of the condition of the color developing unit is set to 2 (step 1008), and then, this sequence is completed.

Figure 12:
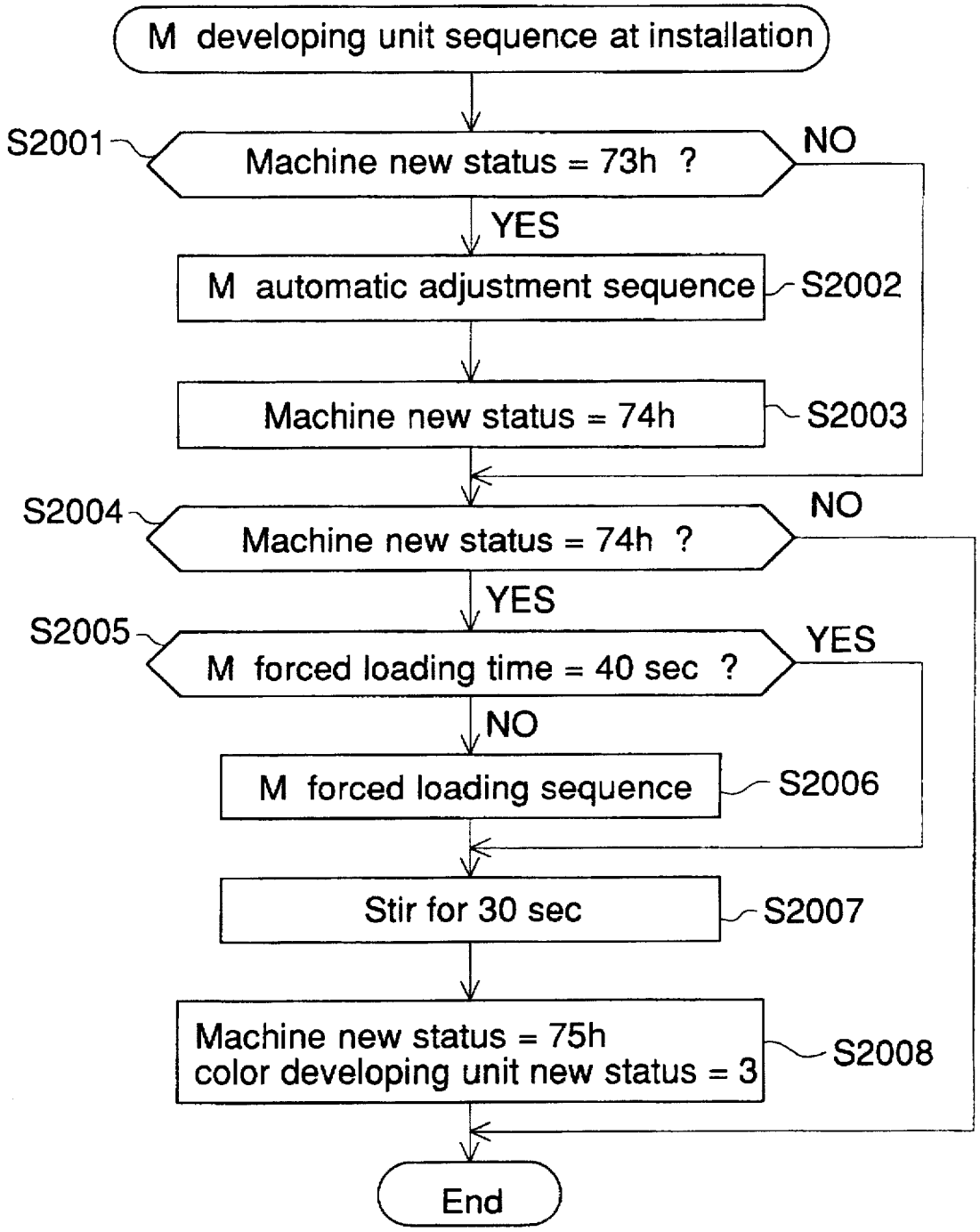
FIG. 12 is a flow chart showing a subroutine in the same example.
Figure 13:
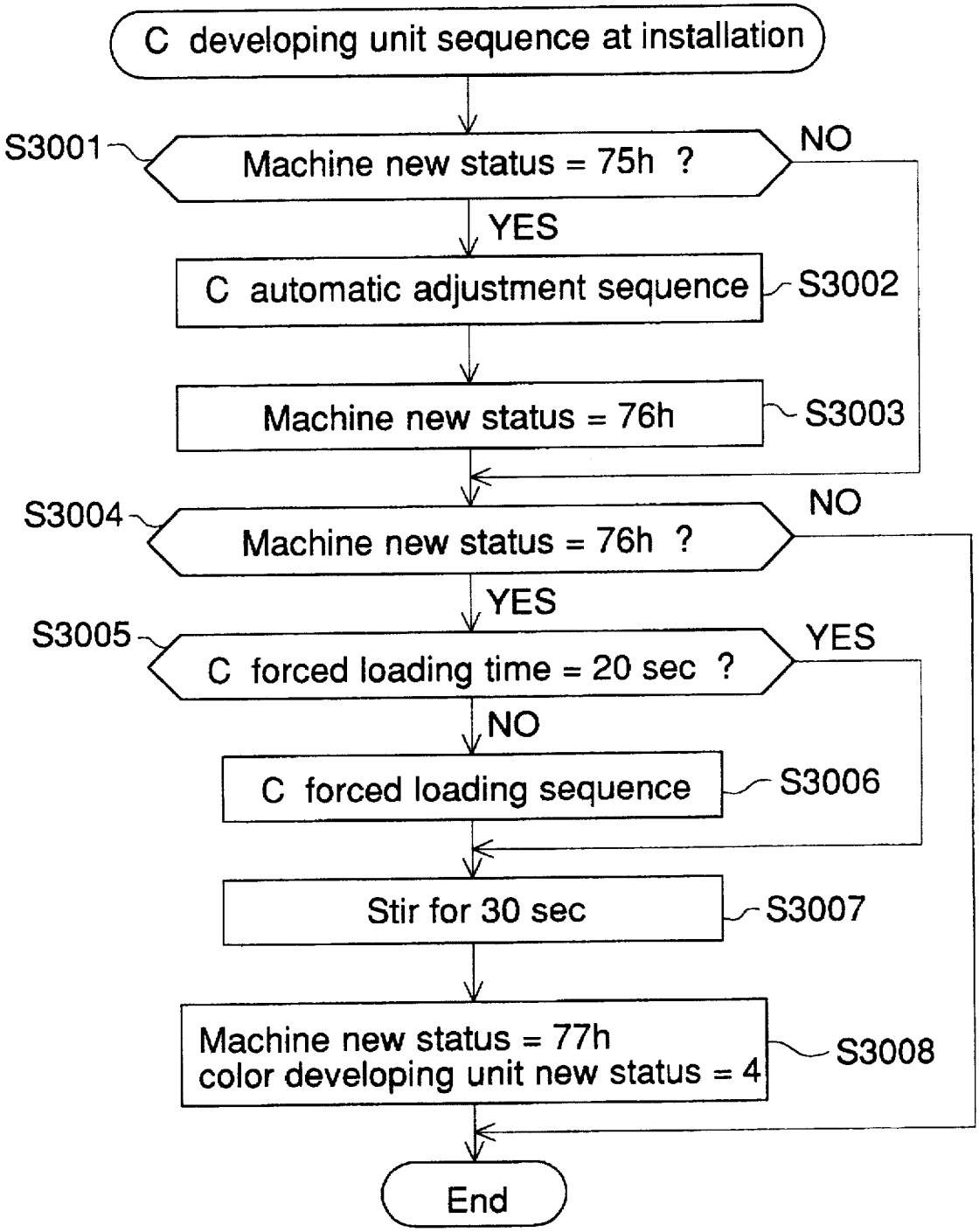
FIG. 13 is a flow chart showing a subroutine in the same example.

In the New color developing unit sequence in FIG. 10, after completion of the Y developing unit sequence at installation, when the value of the Machine new status is not 0h, the same sequence at installation as that of the Y developing unit is succeedingly carried out for the M toner developing unit and the C toner developing unit (refer to flow charts for each sequence shown in FIGS. 12 and 13). Each time when each sequence has been completed, the value of the status of condition of the color developing unit B is increased by 1 (steps 204 through 207). After that, counter values of Y, M and C developing units are cleared to 0 in step 208. As counters of the developing units, two types of counters, a cartridge counter and a life counter are used, and these counter values are cleared (step 208). Finally, the value of the status is set to 5 (step 209).

The sequence at installation of M and C toner developing units is carried out in the same way as that of the Y toner developing unit. However, since the length of the pipe provided from each hopper to each developing unit is different, time is set to a forced loading time corresponding to the pipe length.

On the other hand, when the developing unit B is replaced with new one, but not at installation of the apparatus, it is judged in steps 202, 204 and 206 that the color developing unit B is replaced, by the status value and the value of the Machine new status. Then, in steps 210, 212 and 214, toner concentration adjustment is carried out in the same way as that by stirring (step 1002) which is conducted during the sequence at installation. Since toner is loaded in the pipe provided between the hopper and the developing unit, the forced loading sequence is not carried out.

Even when the sequence is interrupted during the sequence operation at installation or during the sequence operation at replacement of the developing unit, by the judgement in steps 201, 216, 217 and 218, and steps 202, 204 and 206, the completed sequence is not repeated, and the sequence operation can restart from the subsequent sequence which is not yet conducted, corresponding to the status values of the developing unit and the value of the Machine new status, which are changed at the completion of each sequence. When the color developing unit B is a used one, the status value is reset to 0, and accordingly, the new color developing sequence is not carried out.

Figure 14:
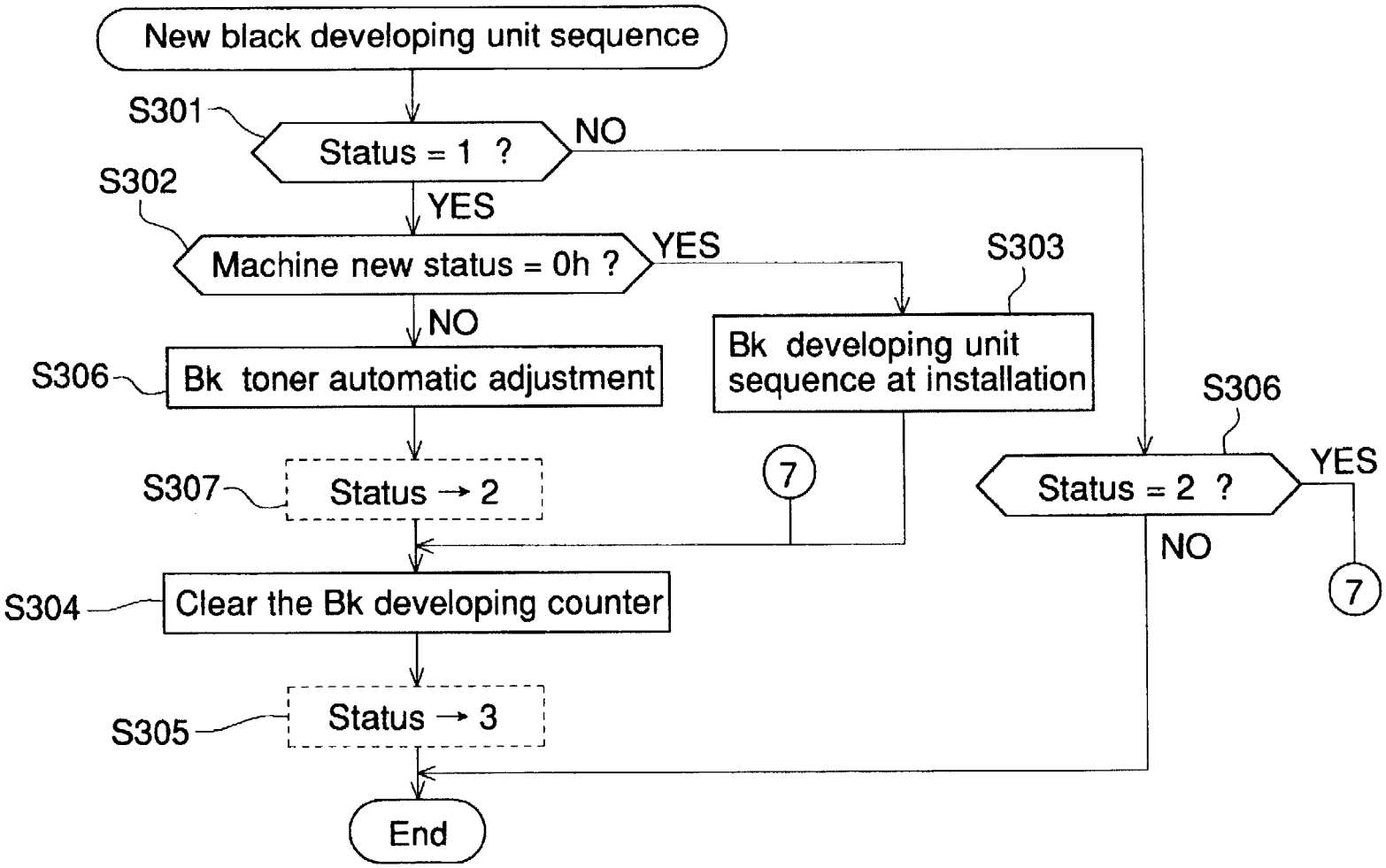
FIG. 14 is a flow chart showing a subroutine in the same example.
Figure 15:
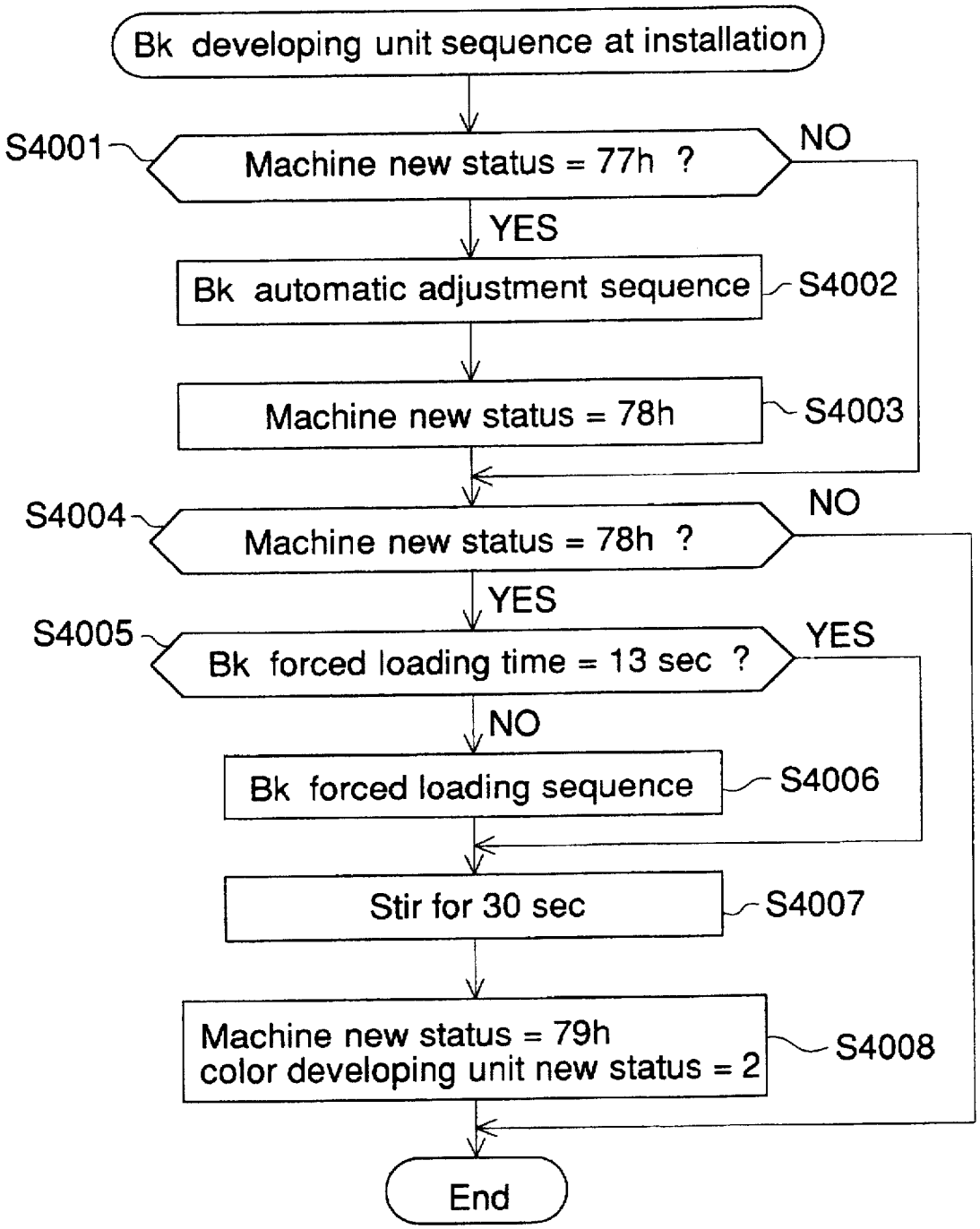
FIG. 15 is a flow chart showing a subroutine in the same example.

After the New color developing sequence has been completed due to the above described operations, when it is judged in steps 45 and 46 in FIG. 7 that the developing unit is at installation, or the black developing unit C is a new one, the sequence advances to step 47 and the New black developing unit sequence is carried out. The New black developing unit sequence and the black developing unit sequence at installation, which is carried out as the subroutine in the New black developing unit sequence, are also carried out in the same way as the sequence, which is carried out in one developing unit of the color developing unit as shown in FIGS. 14 and 15. When the status value showing the condition of the black developing unit and the value of the Machine new status are respectively increased by 1, the completed sequence is skipped and the sequence can restart from the not-completed sequence when the sequence is interrupted, while it is being judged whether the apparatus is at installation or the black developing unit is at replacement. When the developing unit is a used one, the sequence is not carried out, which is the same as that described above. The value of the Machine new status at the completion of the New black developing unit sequence is increased to 79h.

After the initializing operation for both developing units B and C are conducted in this way, when it is judged in step 48 in FIG. 7 that the value of the Machine new status is 79h, which is the value at installation, or it is judged in step 49 that the drum unit A is new, the sequence advances to step 50 and the initializing operation (New drum sequence) for drum unit A is carried out. When it is judged that the drum unit is used, the New drum sequence is not carried out.

Figure 16:
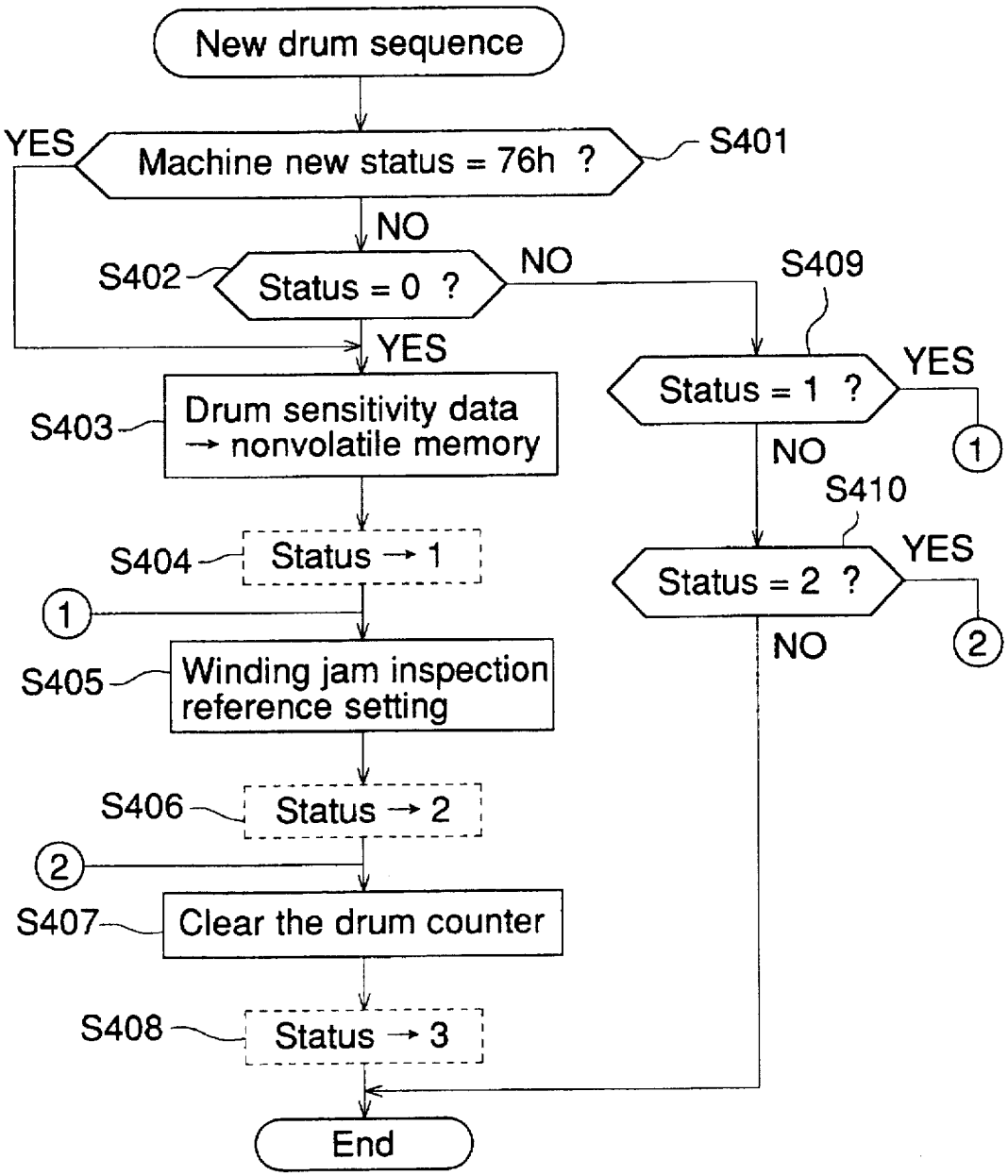
FIG. 16 is a flow chart showing a subroutine in the same example.

In FIG. 16, showing the subroutine of the New drum sequence, when it is judged in step 401 that the photoreceptor drum is at installation of the apparatus, since sensitivity data of the photoreceptor drum, in step 403, which will be described later, has already been inputted at its shipment, the sequence advances to step 405 and succeeding steps, and the operation, which will be described later, is carried out. When it is judged in step 402 that the photoreceptor drum was just replaced with a new one, from the status value of 0, that is, the status value showing the condition of the drum unit, the sequence advances to step 403, and initially, the sensitivity detected from the photoreceptor drum 10 is stored in the non-volatile memory. Here, the sensitivity of the photoreceptor drum 10 means the lowered amount of potential voltage with respect to the exposure amount, or charging ability, which fluctuates for each product. Accordingly, when the sensitivity of the new photoreceptor drum is read in the memory, the concentration of the toner can be appropriately adjusted according to the sensitivity at printing. For example, when the sensitivity is high, since the concentration tends to be higher, correction, by which the toner concentration is decreased, or the like, may be carried out. After such operations, the sequence advances to step 404, the status value is set to 1, which expresses completion of the sequence operations.

Next, in step 405, a signal from the JAM detection sensor 36 is inputted, and setting of the reference level is adjusted by which a wound sheet is judged corresponding to the reflection ratio of the photoreceptor drum 10. That is, when the reflection ratio of the photoreceptor drum 10, which is detected by the reflection type JAM detection sensor 36, is high, the reference level is set to the higher side so that a wound sheet can be easily detected. After completion of these operations, the sequence advances to step 406, and the status value is set to 2, which expresses completion of these sequence operations.

Next, the sequence advances to step 407, and two types of drum counters (a drum unit counter and a drum check counter) are cleared. After that, the sequence advances to step 408 and the status value is set to 3.

Further, when the status value, which is changed at each completion of each operation, is judged in steps 402, 409 and 410, the sequence can restart at the not-completed sequence, by skipping the completed sequence, in case of interruption of the sequence.

Figure 17:
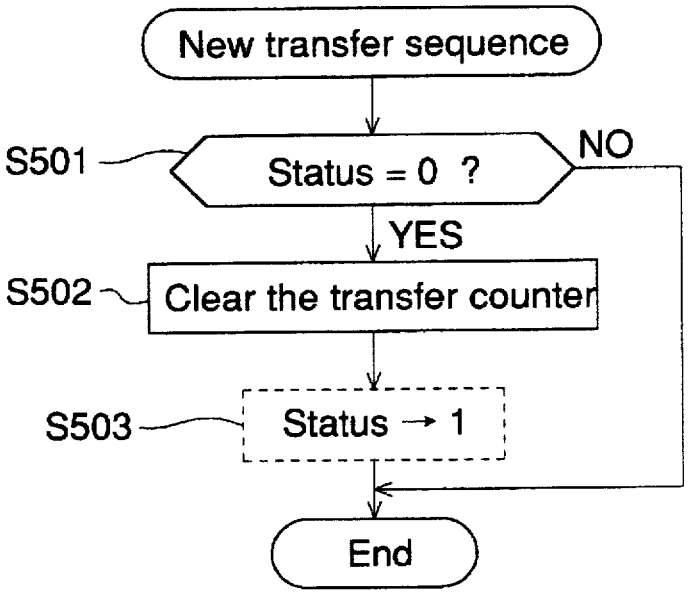
FIG. 17 is a flow chart showing a subroutine in the same example.
Figure 18:
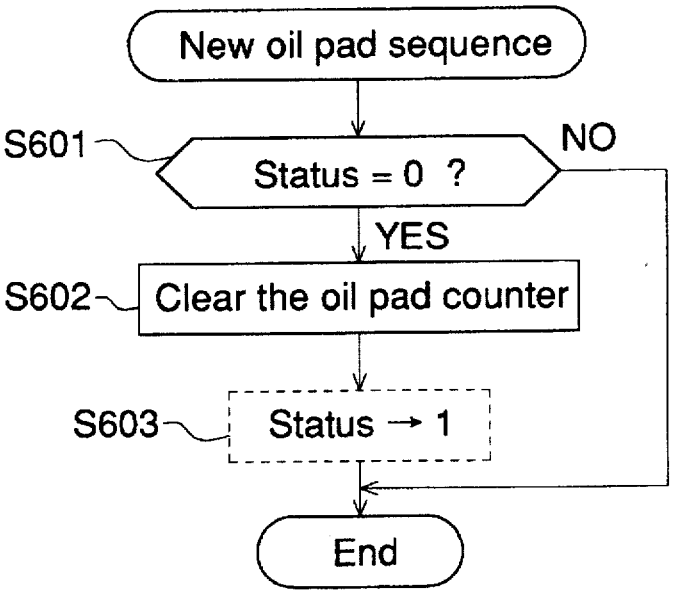
FIG. 18 is a flow chart showing a subroutine in the same example.

The following operations are carried out in the same way as those of the above-described example. In FIG. 7, judgement of a new unit of the transfer and conveyance unit D, and that of the oil pad unit F are successively carried out in steps 51 and 53. When these units are new, the sequences respectively advance to the NEW transfer sequence in step 52, and the NEW oil pad sequence in step 54. Then, as shown in FIGS. 17 and 18, when the status values expressing the respective conditions are 0, that is, when these units are at installation or at replacement, a transfer counter (a counter for the number of printing cycles and occurrence of faults), and an oil pad counter (for the same purpose) are respectively cleared. After that, the status value is increased, and completed operations at interruption of the sequence operations are skipped at restart of the sequence.

When these units are used ones, the NEW transfer sequence and the NEW oil pad sequence are not conducted respectively, which is the same as described above.

Next, the existence or not-existence of new units is judged in step 55 in FIG. 7. In step 56, all fuses $F_1$ to $F_6$ are blown at installation of the apparatus at which all units are new. After that, when one or a plurality of units are replaced, the corresponding fuses of the replaced units are blown. As described above, after these initializing operations have been completed, it is judged that these units are used ones. The sequence advances to step 57, and each status value is reset to the initial value of 0.

In this connection, when each status value is reset to 0 at the completion of all sequence operations, initial adjustment at the replacement of units can be conducted from the first step. However, only by this operation, the initial adjustment is conducted on even a used unit when the status value is reset, in the initializing operation after installation. Accordingly, when the judgement for a new unit or a used unit is conducted depending on the existence or non-existence of a blown fuse, the initial adjustment for the used unit can be securely prevented.

After the initializing operation at install of the apparatus or at replacement of a unit has been completed as described above, operations after step 7 in FIG. 6 are carried out. These operations are carried out also at normal start-up of the apparatus, except for those at installation of the apparatus or replacement of a unit.

The outline of the operations will be explained below. In steps 7 though 10, it is detected according to a signal from respective sensors, provided at positions in a predetermined height in the hoppers, whether the remaining amount of respective yellow, magenta, cyan and black toners in the respective hoppers is sufficient or not.

The existence of a hopper having insufficient toner amount is judged by the insufficient remaining amount detection. When a hopper has an insufficient toner amount, an alarm showing that toner replenishment is required to this hopper, is displayed in step 12, and "toner empty recovery task" to restart the processing operation is started when toner is replenished. When no hoppers have an insufficient toner amount, the developing unit drive motor which is driven at remaining toner amount detection is turned off in step 13, and the sequence advances to step 14.

In step 14, fixing unit warming-up and cleaning is started. In step 15, cleaning is completed, and all processing operations conducted at the power supply to the apparatus, are completed in step 15.

FIG. 19 shows a main routine, conducted at the power supply to the apparatus, of the second example. In this main routine, the following operations are different from the above example. After the installation condition has been detected from the value of the Machine new status in step 4, the existence or non-existence of new units is judged for all units depending on the existence or non-existence of blown fuses. When all units are judged to be new, the toner replenishment waiting operations for the hoppers are conducted in step 5. When there is a unit which is judged to not be new, due to some faults (including a unit loading error), the sequence advances to step 22 and stops the initializing operations.

That is, in the above-described example, a new unit or a used unit is judged for each individual unit after the start of the initializing operations. The processing operation for the unit which is judged not to be new is skipped, and it is conducted after the new unit has been confirmed. This is a structure to maximize the efficiency. In contrast to this, in this example, the initializing operations are not conducted from the first step, and an alarm is displayed and the sequence is stopped, in the faulty case in which it is judged that even one unit is not new at installation of the apparatus. This is based on the most discreet consideration in which the initializing operations should be started only after conditions that all units are new have been prepared.

Figure 20:
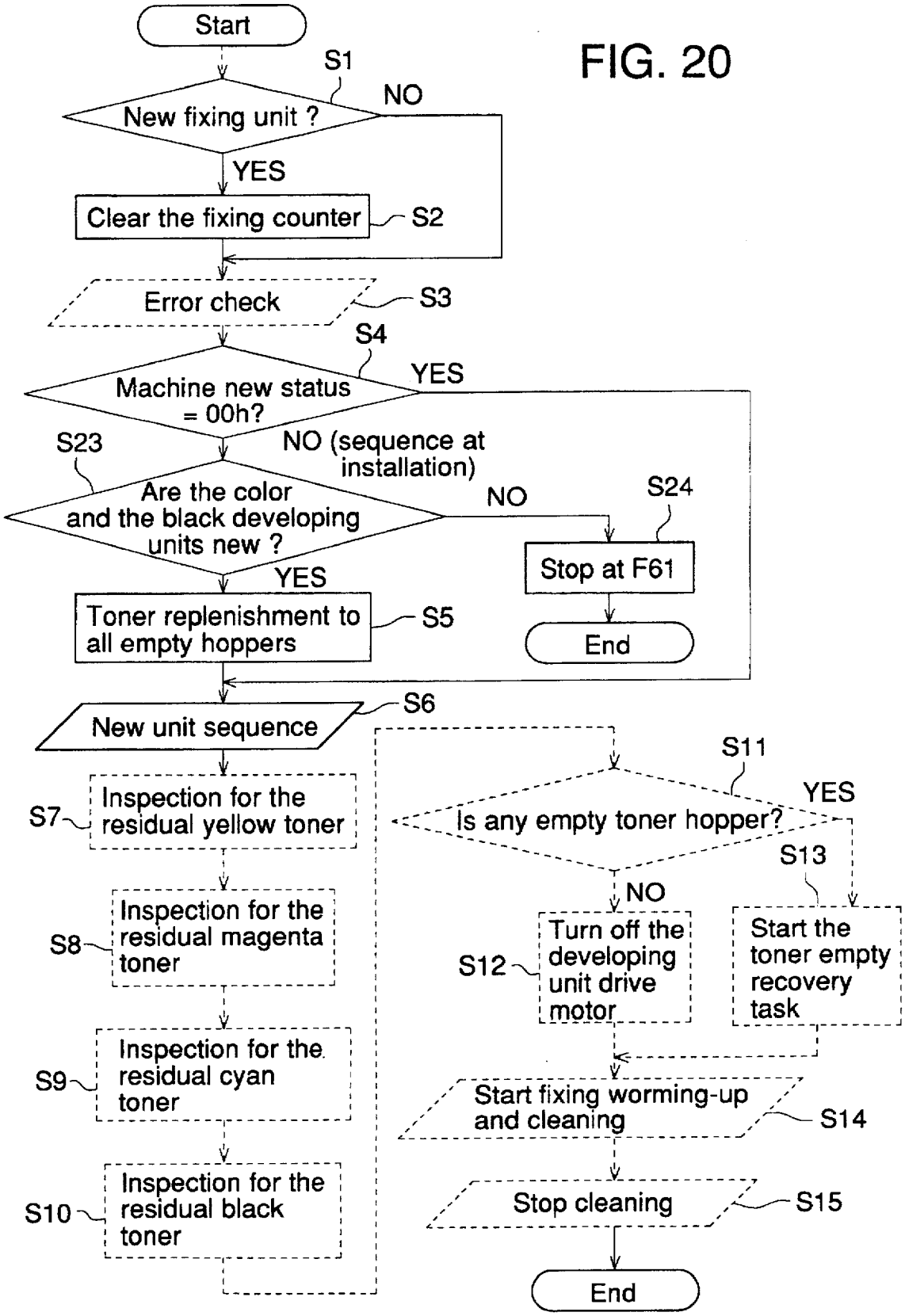
FIG. 20 is a flow chart showing a main initializing processing routine conducted at the power supply in the third example of the present invention.

FIG. 20 shows a main routine of the third example based on the consideration in which the above two examples are blended. In this example, the judgement for a new unit or a used unit is conducted on the color developing unit and the black developing unit in step 23 after the installation condition has been detected. After these units are confirmed to be new, the initializing operations are started. When it is judged that at least one developing unit is not new, an alarm is displayed in step 24, and the operations are stopped. That is, as described above, when other units except the developing unit are adjusted before toner concentration adjustment is conducted, toner concentration is adversely affected. Accordingly, the initializing operation for the developing unit is always conducted as the first priority. Specifically, in the processing for the jam detection constant determination, since the reference patch is formed on the drum, toner in the developing unit is securely consumed. Further, toner in the developing unit is consumed due to some unexpected causes during the initial operation of other units. Since toner is consumed as described above, it is necessary to avoid the risk in which the toner concentration adjustment is conducted after the reference toner concentration of the developer has been changed.

Figure 21:
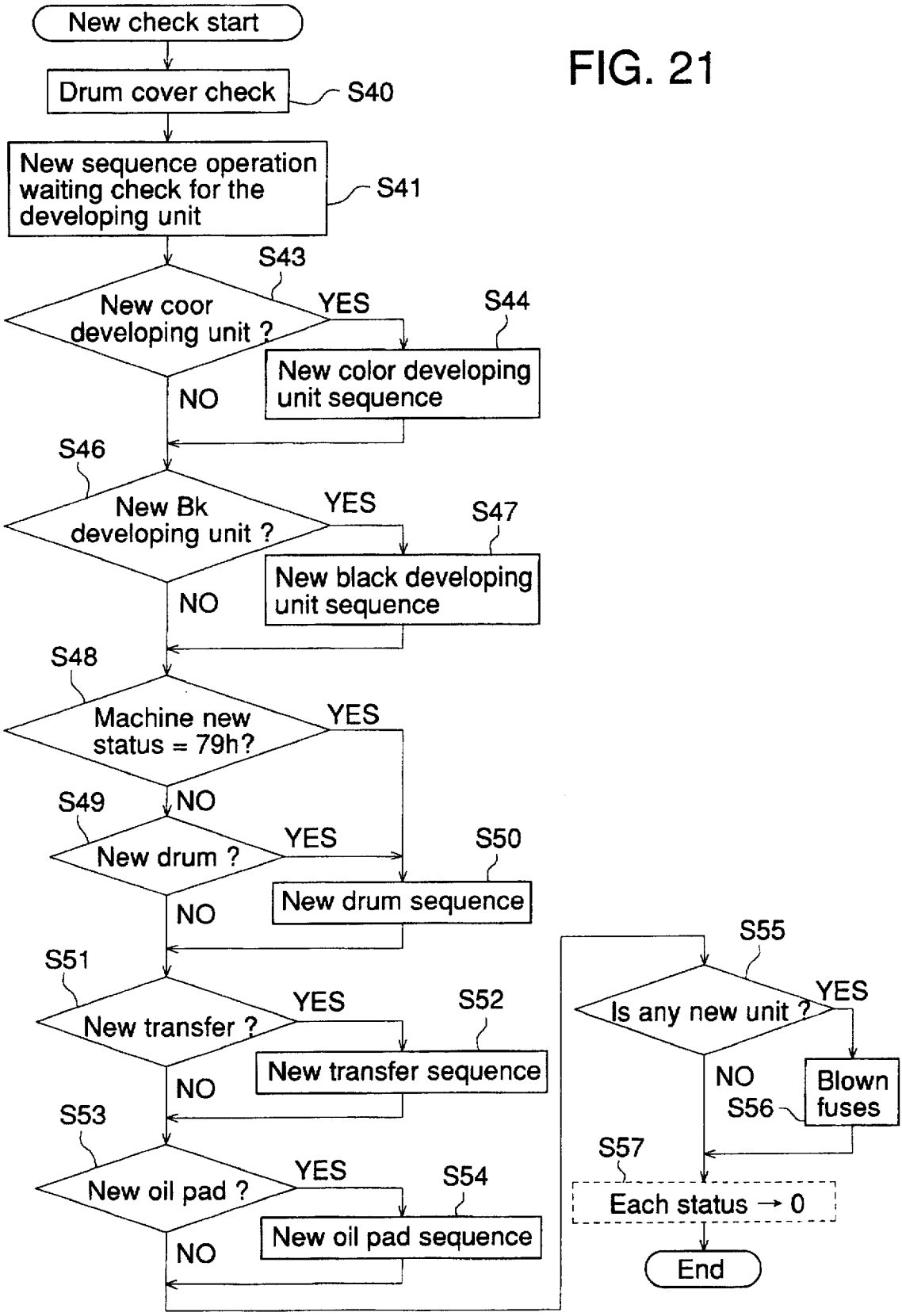
FIG. 21 is a flow chart showing a subroutine in the same example.

In this connection, when the initializing operation is started after the new developing unit has been confirmed as described in this example, the judgement of Machine new status is not conducted in the New unit sequence as shown in FIG. 21, and the New developing unit sequence may be conducted according to judgement only for a new or a used developing unit (in the following fourth example, the same operation is conducted).

Figure 22:
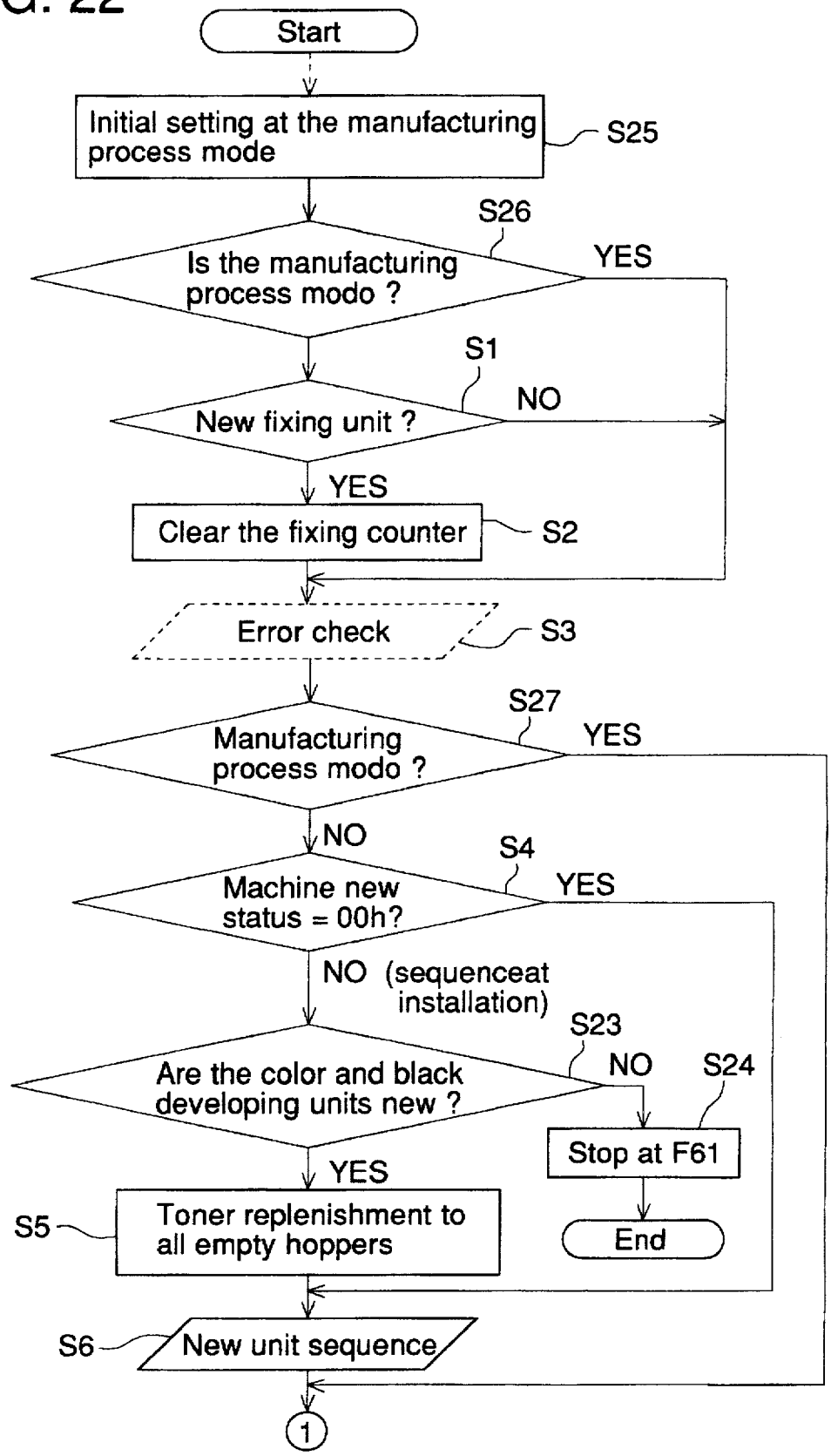
FIG. 22 is a flow chart showing the front stage of a main initializing processing routine conducted at the power supply in the fourth example of the present invention.
Figure 23:
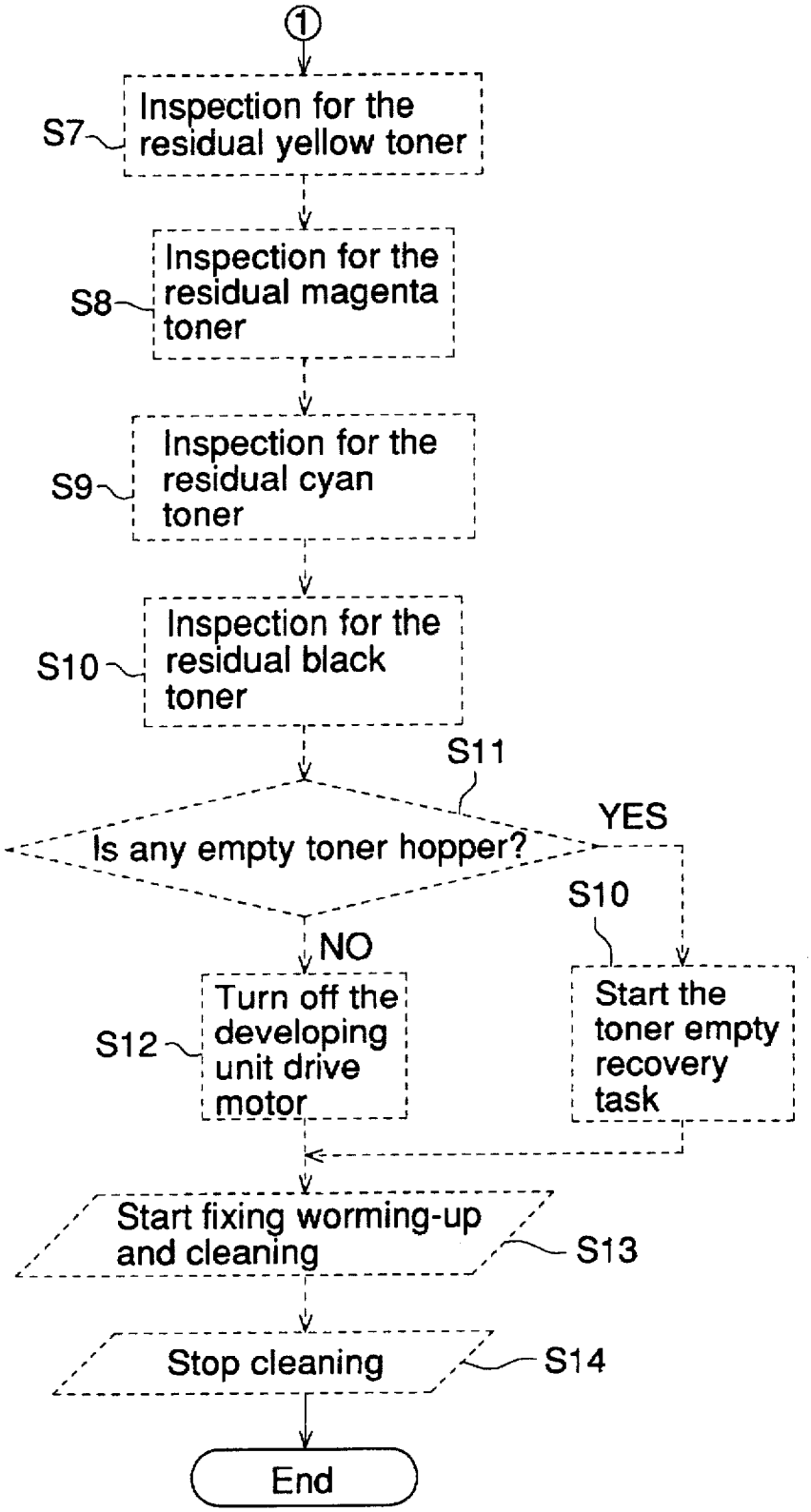
FIG. 23 is a flow chart showing the rear stage of the same main routine.

FIGS. 22 and 23 show the fourth example in which the initial setting operation, conducted during the manufacturing process prior to delivery of the apparatus, is included in the main routine, and in which only necessary operations are conducted in common with the initializing operation at installation of the apparatus.

In step 25, the initial setting operation which is conducted during manufacturing process prior to delivery of the apparatus is conducted. A subroutine for the manufacturing process mode initial setting operation will be explained according to FIG. 23. In step 31, it is judged whether the process mode is set or not. For example, when one side connector formed in a special cord condition, which is special in the common use mode, is connected to a corresponding connector on the apparatus during factory inspection before delivery, since this special connector is disconnected at the delivery, the cord condition of the apparatus becomes normal. Thereby, the process mode is judged. Further, a process mode judgement signal may be previously inputted into the apparatus memory. In this case, the sequence may be set so that the process mode signal is cleared at the completion of the process mode.

Further, in order to avoid blowing fuses in a new unit due to erroneous connector disconnection during the process mode sequence, when the connector is connected to the apparatus side, data to prevent fuse from blowing is set at first in the fuse blowing status memory in the non-volatile RAM (not shown in the drawing). However, the status to prevent blowing fuses is reset at the completion of the process mode.

Figure 25:
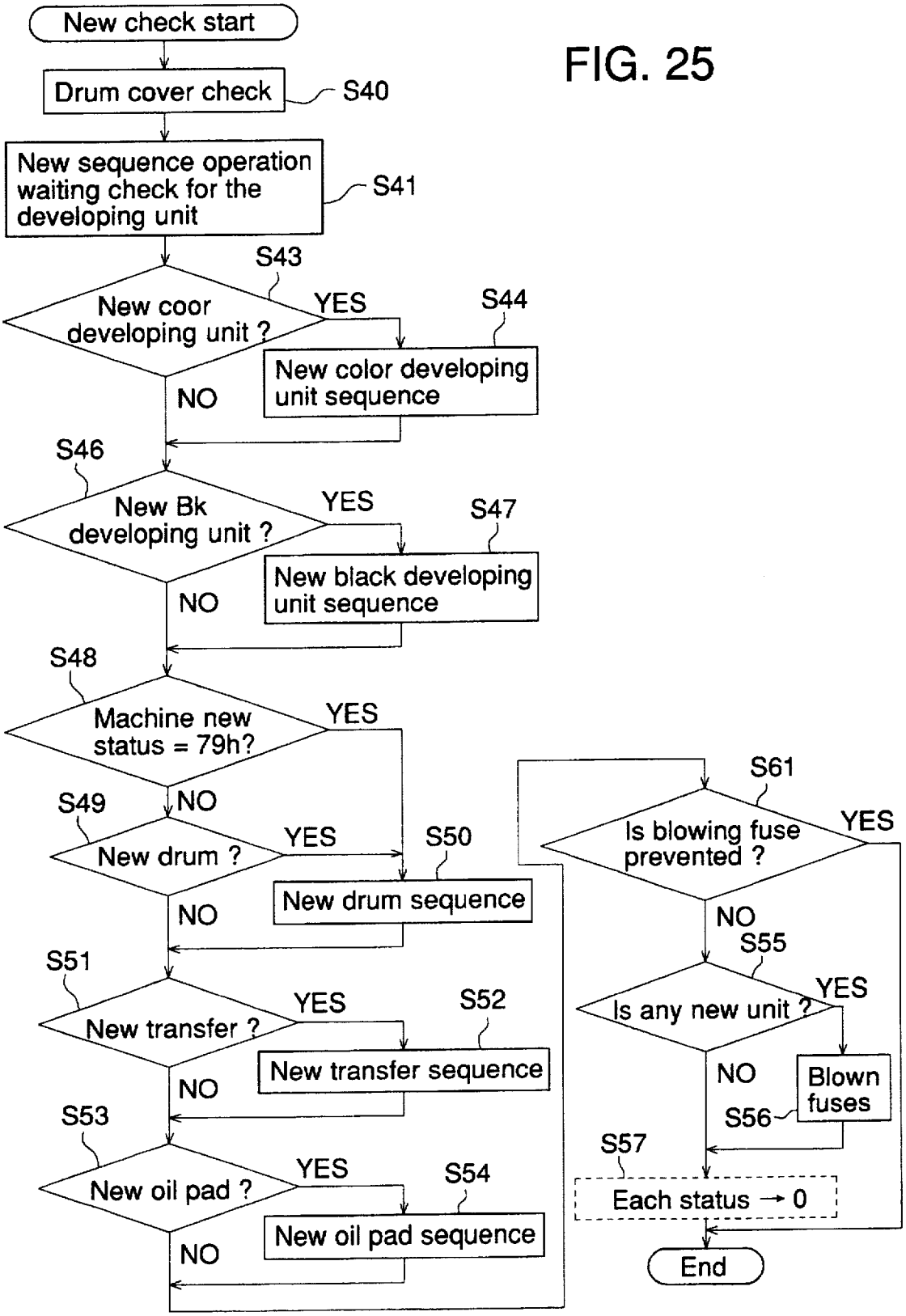
FIG. 25 is a flow chart showing a subroutine in the same example.

In the New unit sequence, as shown in FIG. 25, it is judged in step 61 whether the status is changed to the fuse blowing preventing status, according to the fuse blowing status, before the judgement of the existence or non-existence of the new unit in step 55. When the status is the fuse blowing preventing status, the sequence is not advanced to step 55 and after it, and this sequence is completed and fuse blowing is prevented. Due to this operation, it is prevented that fuses of the new unit are blown even when the connector is erroneously disconnected during the process mode sequence as described above.

Figure 24:
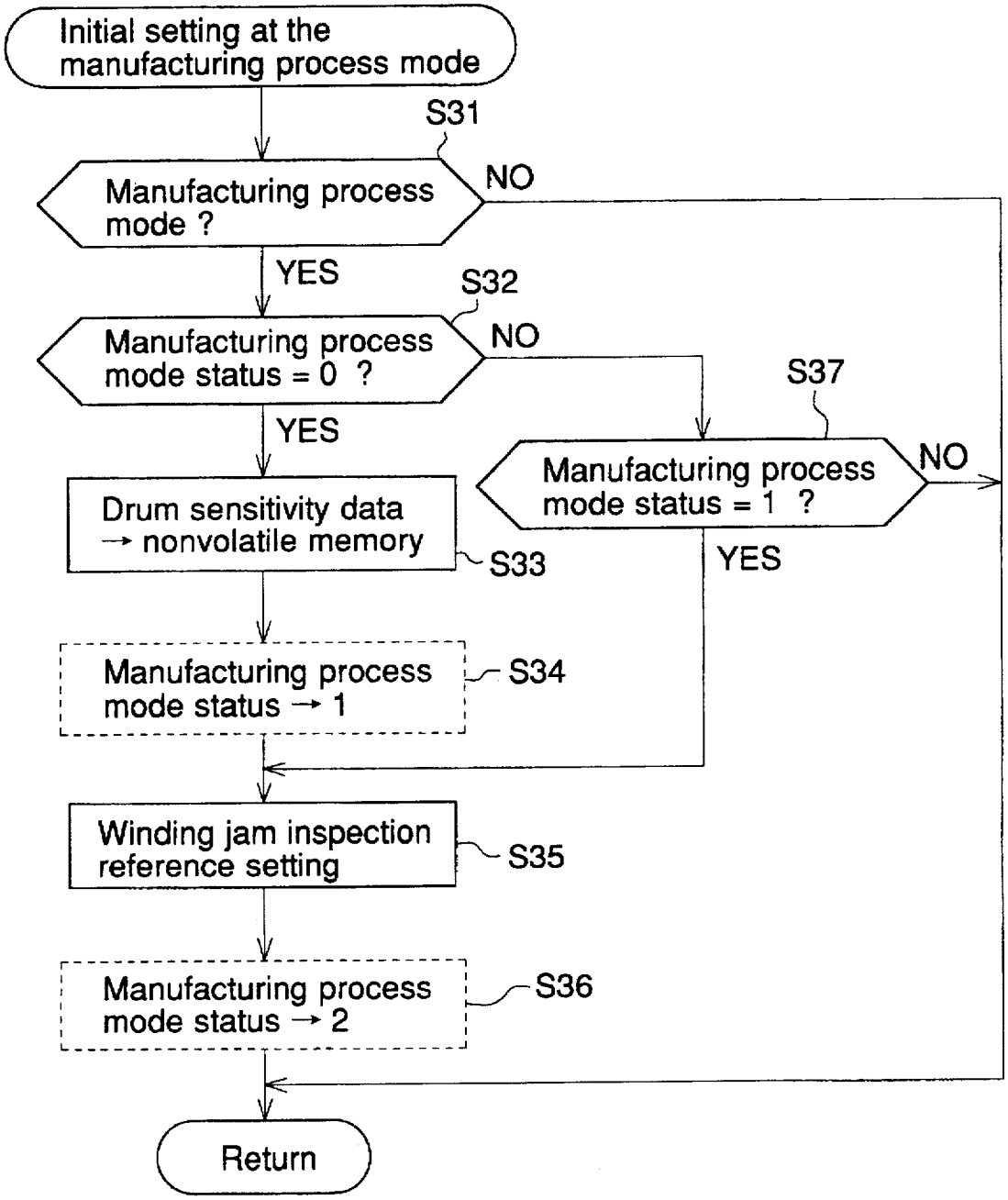
FIG. 24 is a flow chart showing a subroutine in the same example.

In FIG. 24, when it is judged in step 31 that the process mode is set, the sequence advances to step 32, and the counter value is increased at completion of each step of the processing operation. Then, it is judged whether the value of the process mode status, expressing the condition of the drum unit A, is 0, which is the initial value before adjustment.

When the process mode status is 0, the sequence advances to step 33 and after it, and the initializing operation for the drum unit A and setting of the reference value by the wound recording sheet jam detection are conducted in the same way as shown in FIG. 16 (steps 33 and 35). When the status value is increased at completion of each step of the processing operation and judged (steps 34, 36, 37), the sequence can restart from the following new operation step in case of the interruption of the processing operation even in the process mode. The drum counter is not cleared because it is not necessary during the process mode. The value of the process mode status is cleared at delivery of the apparatus.

After the initial setting is completed due to the above-described operations, the sequence advances to step 3 through the process mode judgement in step 26 in FIG. 22, and the error check processing operation is conducted. After that, the initializing operation at the process mode is completed, passing through the process mode judgement again in step 27.

In this connection, when a printing check is conducted in the process mode using toner in the actual developing unit equipped in the apparatus, the sequence may be advanced to step 7 and after it, and the printing check may be conducted after the presence of toner has been assured.

Further, also in this example, the initializing operation is conducted after the new developing unit has been confirmed as described in the third example. In this example, the function check sequence, which is conventionally conducted individually by setting a special mode in each check item during the manufacturing process, can be included in single initializing operation sequence. In this example, the operation efficiency is increased, and the operation time can be reduced by the sequence, which is automatically conducted at installation by the judgement of the process mode, and by eliminating unnecessary operations such as detection of the existence of units at the process adjustment. Further, since the minimum adjustment operation (sensitivity adjustment of the drum unit, or the like) to confirm the operation of the apparatus is automatically conducted only once in the process mode, the initializing operation can be conducted without any trouble.

According to the image forming apparatus of the present invention, since the sequence at installation, including instructions for end-users, for executing initializing operations for a plurality of units is installed into the apparatus, the adjustment for the apparatus, such as a color printer, for which many kinds of adjustments and initializing operations are required at its installation, can be carried out by end-users without the help of a skilled-service man.

As described above, according to the image forming apparatus of the first embodiment, since the initializing processing operation, required at installation of the new apparatus, is automatically conducted, the burden of the initializing operation to end-users is eliminated and occurrence of operation error during installation is minimized.

According to the image forming apparatus of the second embodiment, the initializing operation at installation can be carried out securely and speedy according to information of the condition corresponding to progression of the operation to the apparatus, and information of the progressing condition of the initial adjustment for the unit.

According to the image forming apparatus of the third embodiment, since the sequence skips the completed operation steps and can restart from the next operation step at sequence interruption, wasteful overlap of processing operations can be avoided, and the operation efficiency can be increased.

According to the image forming apparatus of the fourth embodiment, the status of a new unit or a used unit can be checked twice according to information of the status of the apparatus, and information of the judgement of a used unit or a new unit, and an erroneous operations in the initializing operation can be securely prevented due to the error detection.

According to the image forming apparatus of the fifth embodiment, when the adjustment operation of the toner concentration in the developing unit is conducted with a first priority in the initializing operations, the toner concentration can be stabilized and satisfactorily adjusted during adjustment of other units.

According to the image forming apparatus of the sixth embodiment, since the manufacturing process mode is judged and the initializing operations required only during the manufacturing process are carried out, the operation efficiency during the manufacturing process is increased.

What is claimed is:

1. An image forming apparatus comprising:

(a) a sequence memory for storing an initialization processing sequence to be conducted only at installation of the apparatus;

(b) an adjusting means for adjusting the apparatus in accordance with the initialization processing sequence stored in said sequence memory;

(c) apparatus status indicating means for indicating whether the apparatus is new;

(d) control means for controlling said adjusting means so that said adjusting means adjusts the apparatus when said apparatus status indicating means indicates that the apparatus is new; and (e) judging means for judging whether to continue or interrupt the initialization processing sequence on the basis of a predetermined state of the apparatus, wherein said judging means includes means for judging to continue the initialization processing sequence when all units of the apparatus to be initially adjusted are new, and to stop the initialization processing sequence when at least one unit of the apparatus to be initially adjusted is old.

2. The image forming apparatus of claim 1, wherein said said judging means further includes means for judging whether to continue or interrupt the initialization processing sequence on the basis of whether or not an abnormal state occurs in the apparatus.

3. The image forming apparatus of claim 1, wherein said said judging means further includes means for judging whether to continue or interrupt the initialization processing sequence on the basis of whether or not a remaining amount of toner in a toner hopper is sufficient.

4. The image forming apparatus of claim 1, wherein said said judging means further includes means for judging whether to continue or interrupt the initialization processing sequence on the basis of whether or not at least one developing unit of the apparatus is not new.

5. The image forming apparatus of claim 1, further comprising means for interrupting the initialization processing sequence on the basis of a judgment result judged by said judging means.

6. The image forming apparatus of claim 1, further comprising means for interrupting the initialization processing sequence on the basis of a judgment result judged by said judging means, and a display for displaying the judgment result judged by said judging means.

7. The image forming apparatus of claim 1, further comprising:

a plurality of units each of which is respectively required to be initially adjusted when new;

an apparatus status memory for changing and storing a status of the apparatus at installation thereof in accordance with a progression of the initialization processing sequence; and a unit status memory for changing and storing a status of each of the plurality of units in accordance with respective adjustments thereof, wherein said adjusting means carries out the initialization processing sequence on the basis of the status information stored in the apparatus status memory and the unit status memory.

8. An image forming apparatus comprising:

(a) a sequence memory for storing an initialization processing sequence to be conducted only at installation of the apparatus;

(b) an adjusting means for adjusting the apparatus in accordance with the initialization processing sequence stored in said sequence memory;

(b) an adjusting means for adjusting the apparatus in accordance with the initialization processing sequence stored in said sequence memory;

(c) apparatus status indicating means for indicating whether the apparatus is new;

(d) control means for controlling said adjusting means so that said adjusting means adjusts the apparatus when said apparatus status indicating means indicates that the apparatus is new; and (e) judging means for judging whether to continue or interrupt the initialization processing sequence on the basis of a predetermine state of the apparatus;

wherein said judging means includes means for judging whether to continue or interrupt the initialization processing sequence on the basis of whether or not a cover is attached to a photoreceptor drum of the apparatus.

* * * * *